US012630341B1

(12) United States Patent
Steinbauer et al.

(10) Patent No.: US 12,630,341 B1
(45) Date of Patent: May 19, 2026

(54) APPARATUS AND METHOD FOR A CHILD-RESISTANT ORAL NICOTINE CAN

(71) Applicant: SkyX IP Holdings I LLC, New York, NY (US)

(72) Inventors: Martin Steinbauer, New York, NY (US); Jeffrey Chagnon, Somerville, MA (US)

(73) Assignee: SkyX IP Holdings I LLC, New York, NY (US)

( * ) Notice: Subject to any disclaimer, the term of this patent is extended or adjusted under 35 U.S.C. 154(b) by 0 days.

(21) Appl. No.: 19/334,867

(22) Filed: Sep. 20, 2025

Related U.S. Application Data

(63) Continuation of application No. 19/334,865, filed on Sep. 20, 2025.

(60) Provisional application No. 63/880,196, filed on Sep. 11, 2025, provisional application No. 63/871,952, filed on Aug. 28, 2025.

(51) Int. Cl.

| | |
|---|---|
| ***B65D 50/04*** | (2006.01) |
| ***A24F 23/00*** | (2006.01) |
| ***B65D 43/02*** | (2006.01) |
| ***B65D 65/46*** | (2006.01) |

(52) U.S. Cl.
CPC ..... *B65D 50/048* (2013.01); *A24F 23/00* (2013.01); *B65D 43/0231* (2013.01); *B65D 65/466* (2013.01); *B65D 2215/02* (2013.01); *B65D 2543/00092* (2013.01); *B65D 2543/00537* (2013.01); *B65D 2543/00824* (2013.01)

(58) Field of Classification Search
CPC ..... B65D 50/048; B65D 43/0231; B65D 65/466; B65D 2215/02; B65D 2543/00092; B65D 2543/00537; B65D 2543/00824; B65D 50/061; B65D 1/0246; B65D 41/0471; B65D 41/06; A24F 23/00
See application file for complete search history.

(56) References Cited

U.S. PATENT DOCUMENTS

| | | | | |
|---|---|---|---|---|
| 334,865 | A | 1/1886 | Howell | |
| 1,636,323 | A | 7/1927 | Rand | |
| 2,987,207 | A | 6/1961 | Stevoff | |
| 3,212,662 | A | 10/1965 | Webb | |
| 3,497,096 | A | 2/1970 | Smith | |
| 3,749,270 | A | 7/1973 | Affleck | |
| 3,828,957 | A | 8/1974 | Marchant | |
| 4,071,156 | A * | 1/1978 | Lowe | B65D 41/48 215/256 |

(Continued)

FOREIGN PATENT DOCUMENTS

| | | | |
|---|---|---|---|
| KR | 20230007871 | A | 1/2023 |
| KR | 102656433 | B1 | 4/2024 |
| WO | 2019136506 | A1 | 7/2019 |

OTHER PUBLICATIONS

Office Action for U.S. Appl. No. 19/328,723, dated Jan. 5, 2026, 12 pages.

(Continued)

*Primary Examiner* — Shawn M Braden
(74) *Attorney, Agent, or Firm* — POLSINELLI PC

(57) ABSTRACT

Provided herein is a child-resistant can including a base and a lid. The base may include a bottom plate, a base circumferential wall, and an interior surface defined by the bottom plate and base circumferential wall. The lid may be configured to enclose the interior surface.

20 Claims, 27 Drawing Sheets

(56) References Cited

U.S. PATENT DOCUMENTS

| | | | | |
|---|---|---|---|---|
| 4,376,493 | A | 3/1983 | Gall | |
| 4,548,331 | A | 10/1985 | Montgomery | |
| 4,732,288 | A | 3/1988 | Morris, Sr. | |
| 4,747,518 | A | 5/1988 | Laauwe | |
| 4,753,189 | A * | 6/1988 | Mastman | A61J 7/04 215/222 |
| 5,083,671 | A * | 1/1992 | Hayes | B65D 50/061 220/837 |
| 5,317,796 | A | 6/1994 | Hunter | |
| 5,476,181 | A | 12/1995 | Seidler | |
| 5,686,700 | A | 11/1997 | Carpinella | |
| 5,816,422 | A | 10/1998 | Roig | |
| 5,967,352 | A | 10/1999 | Repp | |
| 6,105,803 | A | 8/2000 | Standish | |
| 6,772,902 | B1 * | 8/2004 | White | B65D 50/046 220/283 |
| 7,040,499 | B1 | 5/2006 | Reif | |
| 7,404,495 | B2 * | 7/2008 | Keung | B65D 47/0804 215/217 |
| 8,113,366 | B2 | 2/2012 | House | |
| 8,292,110 | B2 * | 10/2012 | Rutter | B65D 47/0838 220/817 |
| 8,689,995 | B2 | 4/2014 | Letica et al. | |
| 9,016,491 | B2 | 4/2015 | Blum | |
| 9,033,172 | B2 | 5/2015 | Thati | |
| 9,950,844 | B2 | 4/2018 | Barber et al. | |
| 9,968,516 | B2 | 5/2018 | Rogers et al. | |
| 10,118,742 | B2 | 11/2018 | Paul | |
| 11,767,150 | B2 | 9/2023 | Darst | |
| 2001/0047976 | A1 | 12/2001 | Frank | |
| 2006/0169603 | A1 * | 8/2006 | Lancesseur | B65D 81/266 206/204 |
| 2006/0186080 | A1 | 8/2006 | Chae | |
| 2006/0278600 | A1 | 12/2006 | Zavala | |
| 2007/0039914 | A1 | 2/2007 | Buono | |
| 2009/0194500 | A1 | 8/2009 | House | |
| 2011/0303659 | A1 | 12/2011 | Perlman | |
| 2012/0248106 | A1 | 10/2012 | Marta | |
| 2013/0062347 | A1 | 3/2013 | Webster | |
| 2013/0214004 | A1 | 8/2013 | Dejonge | |
| 2015/0321804 | A1 | 11/2015 | Koller et al. | |
| 2016/0074280 | A1 | 3/2016 | Miceli | |
| 2017/0113851 | A1 | 4/2017 | Martin et al. | |
| 2020/0039708 | A1 | 2/2020 | Twist | |
| 2021/0122533 | A1 | 4/2021 | Kittmann | |
| 2022/0055805 | A1 | 2/2022 | Goldberg | |
| 2022/0194054 | A1 | 6/2022 | Hession | |
| 2023/0211928 | A1 | 7/2023 | Sanchez | |

OTHER PUBLICATIONS

Office Action for U.S. Appl. No. 19/328,823, dated Jan. 5, 2026, 14 pages.

Office Action for U.S. Appl. No. 19/329,239, dated Jan. 5, 2026, 12 pages.

Office Action for U.S. Appl. No. 19/329,266, dated Jan. 5, 2026, 10 pages.

Non-Final Office Action for U.S. Appl. No. 19/328,797, dated Feb. 19, 2026, 18 pages.

* cited by examiner

APPARATUS AND METHOD FOR A CHILD-RESISTANT ORAL NICOTINE CAN

CROSS-REFERENCE TO RELATED APPLICATIONS

This application is a continuation of U.S. patent application Ser. No. 19/334,865, filed on Sep. 20, 2025, and titled "APPARATUS AND METHOD FOR A CHILD-RESISTANT ORAL NICOTINE CAN", which claims the benefit of U.S. Provisional Patent Application Ser. No. 63/871,952, filed on Aug. 28, 2025, and titled "APPARATUS AND METHOD FOR A CHLID-PROOF ORAL NICOTINE CAN", and U.S. Provisional Patent Application Ser. No. 63/880,196, filed on Sep. 11, 2025, and titled "APPARATUS AND METHOD FOR A CHILD RESISTANT ORAL NICOTINE CAN," both of which are incorporated by reference herein in their entirety.

BACKGROUND

In recent years, the consumption of oral nicotine products has increased significantly, leading to heightened concerns regarding the safety of these products, particularly in households with children. Oral nicotine products, such as lozenges, gum, and pouches, often contain concentrated levels of nicotine, which pose a substantial risk of poisoning if ingested by children. Furthermore, the increased market presence of these products, often flavored to resemble candies, exacerbates the risk of accidental ingestion by making them visually appealing to children.

Additionally, regulatory organizations may mandate child-resistant packaging for products containing hazardous substances. Oral nicotine products must comply with these regulations to ensure the safety of consumers and to prevent incidents of accidental poisoning. There are various guidelines for making cans child-resistant such as ISO8317 and 16 CFR 1700. Child-resistance refers to children up to a certain age not being able to open the product, while adults generally can do so. More specifically, most standards require that young children aged 42-51 months cannot open the product. For ISO 8317, at least 85% of children must not be able to open the package within 5 minutes. Secondarily, even after demonstrating to these children how to open the package, at least 80% of children cannot do so in the following 5 minute test. At the same time, at least 90% of adults (aged 50-70) must be able to open and close the packaging successfully within 5 minutes. For 16 CFR 1700, the requirement is that 80% or more of the test children fail to open the package within the 10-minute period, meaning no more than 20% of the children were successful in opening it. For senior adult effectiveness, at least 90% of seniors must be able to successfully open and reclose the can.

At the same time, it is important to maintain low-barrier access to oral nicotine products, such as pouches and lozenges, for adult consumers, as these products play a significant role in tobacco harm reduction strategies by offering adult users a means to consume nicotine without the detrimental effects associated with smoking combustible tobacco products. Even cans which comply with various guidelines, they may not be entirely child-resistant or conversely, they may be so difficult to open that they pose barriers to adult consumers. Additionally, in some instances, solutions which require significant alterations to existing cans and/or addition of complex systems or additional materials may present a cost or reliability barrier. Accordingly, solutions are needed for these issues, in order to provide child-resistant cans which are accessible to adult consumers and economical to produce.

BRIEF SUMMARY

Disclosed herein is a child-resistant can. According to some aspects the child-resistant can may include: a base comprising a bottom plate, a base circumferential wall extending from the bottom plate (the bottom plate and the base circumferential wall defining an interior surface and an opposing exterior surface), the base circumferential wall comprising a groove in the exterior surface, the groove having a first portion, a second portion, and a third portion; and a lid configured to enclose the interior surface, the lid including a top plate, and a lid circumferential wall extending from the top plate and configured to abut against the exterior surface of the base circumferential wall, the lid circumferential wall comprising a flex mechanism configured to be received in the groove, the flex mechanism comprising a projection and a snap arm attached to the projection. The snap arm may be moveable in relation to the projection, and the snap arm may be configured to abut against an upper portion of the groove, thereby providing a downward force to the lid.

According to some embodiments, the upper portion of the groove includes at least a portion of an upper wall of the second portion of the groove. According to some aspects, the first portion may be connected to the second portion at a first angle and the second portion may be connected to the third portion at a second angle, and the first angle may be about 60 degrees to about 120 degrees and the second angle may be about 60 degrees to about 120 degrees. According to some embodiments, the first angle may be about 90 degrees and the second angle may be about 90 degrees.

According to some aspects, the snap arm extends upwards at an angle from the projection in a natural state. The snap arm may be moveable to a compressed state via a lift force provided by a user to the lid to overcome the downward force. Additionally, the downward force provided by the snap arm may be operable to secure the projection within the first portion of the groove.

According to some aspects, the can may include at least one of aluminum, a plant-based plastic, or a petroleum-based plastic. According to some embodiments, the can is formed of a biodegradable material. The plant-based plastic may be one or more selected from the group consisting of polylactic acid (PLA), polyhydroalkanoates (PHAs), polyhydroxy butyrate (PHB), polyhdroxyvalerate (PHV), and polyhydroxy hexanoate (PHH); and the petroleum-based plastic may be one or more selected from the group consisting of polyglycolic acid (PGA), polybutylene succinate (PBS), polycaprolactone (PCL), polybutylene adipate terephthalate (PBAT), and oxo-degradable polypropylene (oxo-PP).

According to some embodiments, the groove may include a plurality of grooves and/or the flex mechanism may include a plurality of flex mechanisms.

According to some aspects, a depth of the first portion, the second portion, and the third portion may be within a range of about 0.8 mm to about 5 mm. According to some embodiments, the depth may be within a range of about 1 mm to about 3 mm. According to some aspects, a width of the first portion, the second portion, and the third portion may be within a range of about 0.8 mm to about 5 mm. According to some embodiments, the width may be within a range of about 1 mm to about 3 mm. According to some aspects, a diameter of the can may be within a range of about 50 mm to about 100 mm. According to some aspects, a height of the can may be within a range of about 10 mm to about 30 mm.

Also disclosed are methods of closing child-resistant cans. According to some embodiments, such methods may include positioning the lid above the base, aligning the flex mechanism with the third portion, translating the lid downwards such that the flex mechanism passes through the third portion; and rotating the lid such that the flex mechanism passes through the second portion and the snap arm secures the projection into the first portion.

Further disclosed are methods of opening child-resistant cans. According to some embodiments, such methods may include lifting the lid to provide the lift force, thereby transitioning the snap arm to the compressed state, rotating the lid such that the flex mechanism travels through the second portion, and lifting the lid such that the flex mechanism travels through and out of the third portion.

According to some aspects, the child-resistant can may include: a base including a bottom plate, a base circumferential wall surrounding and extending from the bottom plate (the bottom plate and the base circumferential wall defining an interior surface and an opposing exterior surface), the base circumferential wall comprising a base projection extending inward from the interior surface, and a snap-fit connector comprising a body and a snap projection extending from an upper portion of the body; and a lid configured to enclose the interior surface, the lid including a top plate comprising an indent configured to receive the snap projection, the indent comprising a recessed portion configured to engage the snap projection; and a lid circumferential wall extending from the top plate and configured to abut against the interior surface of the base circumferential wall, the lid circumferential wall comprising a lid projection vertically aligned with the recessed portion. The base projection may be configured to abut against an upper surface of the lid projection when the lid is coupled to the base, and the snap-fit connector may be configured to be pulled outward from the base circumferential wall, thereby disengaging the snap projection from the recessed portion.

According to some aspects, the snap-fit connector may extend from the base circumferential wall and provide audible, visual, or tactile feedback when engaged. The can may include multiple snap-fit connectors, with a width ranging from about 10 mm to about 20 mm, and more specifically from about 12 mm to about 17 mm. The snap projection may be designed with an angled surface to facilitate removal. The base circumferential wall may comprise an inner wall and an outer shell, with the snap-fit connector potentially formed in the outer shell and the base projection on the inner wall. A groove in the inner wall may secure to a shell projection of the outer shell.

The disclosure also describes methods for opening and closing the can. According to some embodiments, opening may involve pulling the snap-fit connector outward, rotating the lid to disengage projections, and lifting the lid. Closing may involve pulling the connector outward, placing the lid on the base, and rotating to engage the projections.

According to some aspects, the child-resistant can may include a base with a bottom plate and a circumferential wall. The wall may define both interior and exterior surfaces, with an interior base projection that may extend inward and an exterior base projection that may extend outward. The can may include a lid configured to enclose the interior surface, with a top plate and a circumferential wall that may abut the base wall. The lid may feature a projection that may extend inward. A snap-fit connector may extend from the top plate outside the lid circumferential wall, designed to abut the exterior surface of the base wall. The connector may include a body with a hole operable to receive the exterior base projection, potentially ensuring secure engagement with the lid projection when coupled to the base.

According to some aspects, the interior base projection may engage an upper portion of the lid projection to prevent upward motion. The snap-fit connector may have a hole that extends entirely or partially through it, and both the interior and exterior base projections may be evenly spaced around the base circumference. The can may include multiple snap-fit connectors and projections.

According to some aspects, the can's dimensions may include a diameter ranging from about 50 mm to 100 mm and a height from about 10 mm to 30 mm. The width of the snap-fit connector may range from about 10 mm to 20 mm. The can may be made from materials such as aluminum, plant-based plastics, or petroleum-based plastics, with options for biodegradable materials.

According to some aspects, methods for opening the can may involve pulling the snap-fit connector to disengage projections, rotating the lid, and lifting it away. Closing the can may involve aligning and rotating the lid to engage the projections securely.

According to some aspects, a child-resistant can may include a base with a bottom plate and a circumferential wall. The wall may define an interior and an opposing exterior surface and may feature a groove with a sloped surface at one end. The can may also include a lid configured to enclose the interior surface. The lid may comprise a top plate and a circumferential wall that may abut the exterior surface of the base wall. The lid's circumferential wall may include an inward projection with a sloped surface, designed to be received in the groove.

According to some aspects, the child-resistant can may include features such as a sloped projection surface with a horizontal component. This surface may cause a decrease in the thickness of the projection, potentially ranging from about 10 degrees to about 80 degrees, and more specifically from about 30 degrees to about 60 degrees. The groove may also have a horizontal sloped surface designed to interface with the projection surface, with similar angle specifications.

According to some embodiments, the can may also feature a vertical sloped projection surface with angles of decrease in thickness ranging from about 10 degrees to about 80 degrees, and more specifically from about 30 degrees to about 60 degrees. The can's dimensions may include a diameter ranging from about 50 mm to 100 mm and a height from about 10 mm to 30 mm.

According to some embodiments, materials for the can may include aluminum, plant-based plastics, or petroleum-based plastics, with options for biodegradable materials. Specific plant-based plastics may include polylactic acid (PLA) and others, while petroleum-based options may include polyglycolic acid (PGA) and others.

According to some embodiments, methods for opening the can may involve rotating the lid to engage the sloped surfaces, applying rotational force to slide the projection out of the groove, and lifting the lid. Closing the can may involve aligning the projection with the groove and pushing the lid downward to snap the projection into place.

Terms and Definitions

As used in the specification and the appended claims, the singular forms "a," "an," "the" and the like include plural referents unless the context clearly dictates otherwise. Also, while reference may be made herein to quantitative measures, values, geometric relationships or the like, unless otherwise stated, any one or more if not all of these may be absolute or approximate to account for acceptable variations that may occur, such as those due to engineering tolerances or the like.

As used herein, "active ingredient" refers to a chemical component that is biologically active and is responsible for the intended therapeutic effects or desired outcomes of a formulation, such as a pharmaceutical product, agricultural product, personal care item, or stimulant product. As used herein, the "active ingredient" may comprise or consist of nicotine. As used herein, "excipient" refers to refers to an inactive substance formulated alongside the active ingredient, serving as the vehicle or medium for active ingredient delivery. Excipients may help to stabilize, preserve, or enhance the absorption of the active ingredient, and can also improve product characteristics like taste, appearance, and consistency.

As used herein, "horizontal" refers to a direction parallel to the bottom plate of the base of the disclosed cans, whiled "vertical" refers to a direction perpendicular to the bottom plate of the disclosed cans. "Upwards" refers to a direction perpendicular to the bottom plate of the disclosed cans, generally moving away from the bottom plate and in the opposite direction from gravity, when the can is resting on a surface on its bottom plate. "Downwards" refers to the opposite direction from upwards.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

DETAILED DESCRIPTION

A persistent issue with child-proofing cans or making cans child-resistant is structurally configuring cans such that the cans are not easily openable by children, but are intuitively easy for adults to open.

Child-resistant cans may include numerous design considerations. For example, design considerations may include how a safety mechanism is deactivated, how the can is opened, how the can is closed, if the can safety mechanism needs to be reset, and if the can provides any feedback related to reactivation of the safety mechanism. Deactivating a safety mechanism may include embodiments where the safety mechanism must be held to deactivate it or where the safety mechanism does not need to be held to deactivate it. Closing the can may include reversing an opening motion or an alternative motion. Resetting the safety mechanism may include automatic resets or manually resets. Feedback for reactivation of the safety mechanism may include continuous indications of reset, an indication at the time of reset, or no indication of reset. In some examples, indicators for confirming that the safety mechanism is reactivated may include visual, audible, and/or tactile indicators. Visual indicates may include aligned features, position changes, visible/hidden features, and/or an indicator color or window. Audible indicators may include clicks, ratchet noises, dings, rattles, scraping noises, and/or grinding noises. Tactile indicators may include clicks, ratchets, spring forces, friction forces, pressure, and/or indents.

Some child-resistant cans may include "one-time" child-resistant cans, meaning that the cans are child-resistant only upon a first opening of the can. Some child-resistant cans may be child-resistant every time the can is closed and reopened, meaning that the cans can be relocked every time the cans are closed.

FIG. 1A to FIG. 1D illustrate can shapes suitable for child-resistant cans. For example, the can may include a disc shape 100, a box shape 102, a dowel shape 104, and/or a pouch shape 106. In some examples, other shapes may be used. For example, the can may have an irregular shape such as an ellipse shape, a tear drop shape, a triangular shape, a pentagonal shape, a hexagonal shape, or other shapes.

Figure 1A:
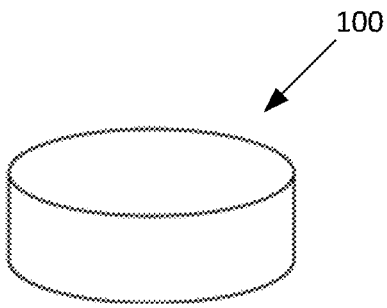
FIG. 1A illustrates a can in accordance with one embodiment.
Figure 1B:
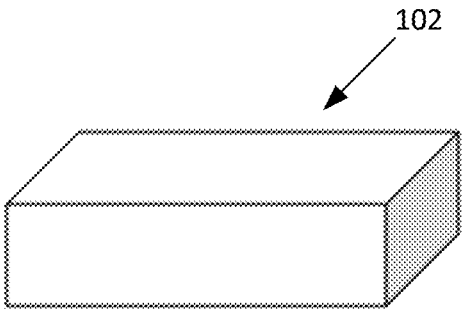
FIG. 1B illustrates a can in accordance with one embodiment.
Figure 1C:
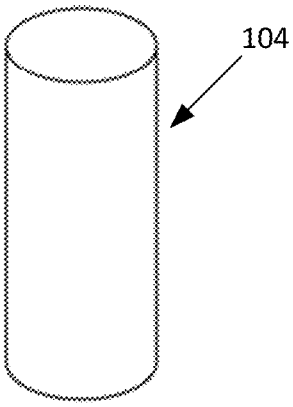
FIG. 1C illustrates a can in accordance with one embodiment.
Figure 1D:
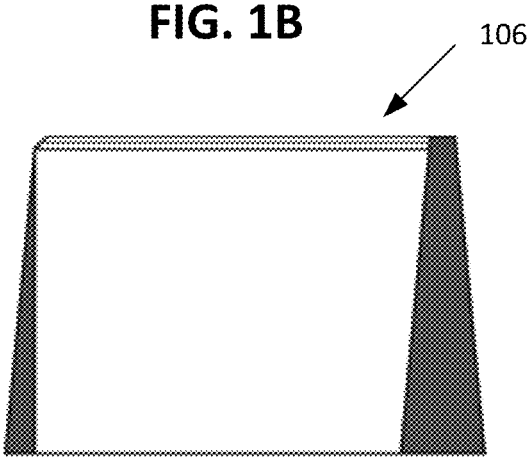
FIG. 1D illustrates a can in accordance with one embodiment.
Figure 2:
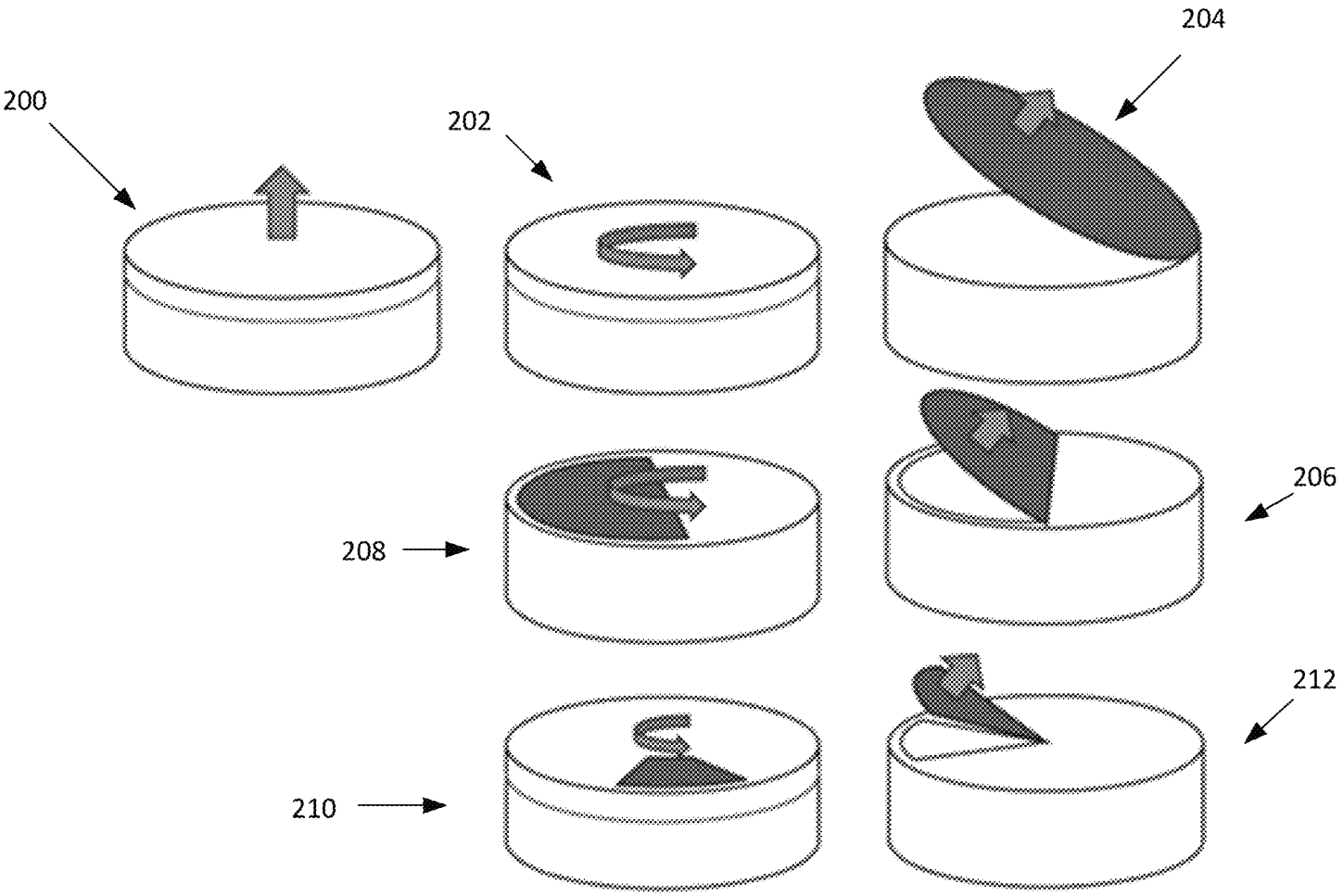
FIG. 2 illustrates various can opening methods in accordance with one embodiment.

FIG. 2 illustrates various methods for opening a can having a disc shape 100. For example, methods for opening a can having a disc shape 100 may include a pop-off top 200, a twist off top 202, a twist to open a large opening 208, a twist to open a small opening 210, a flip off large top 204, a flip off half top 206, and/or a flip off small top 212.

Figure 3:
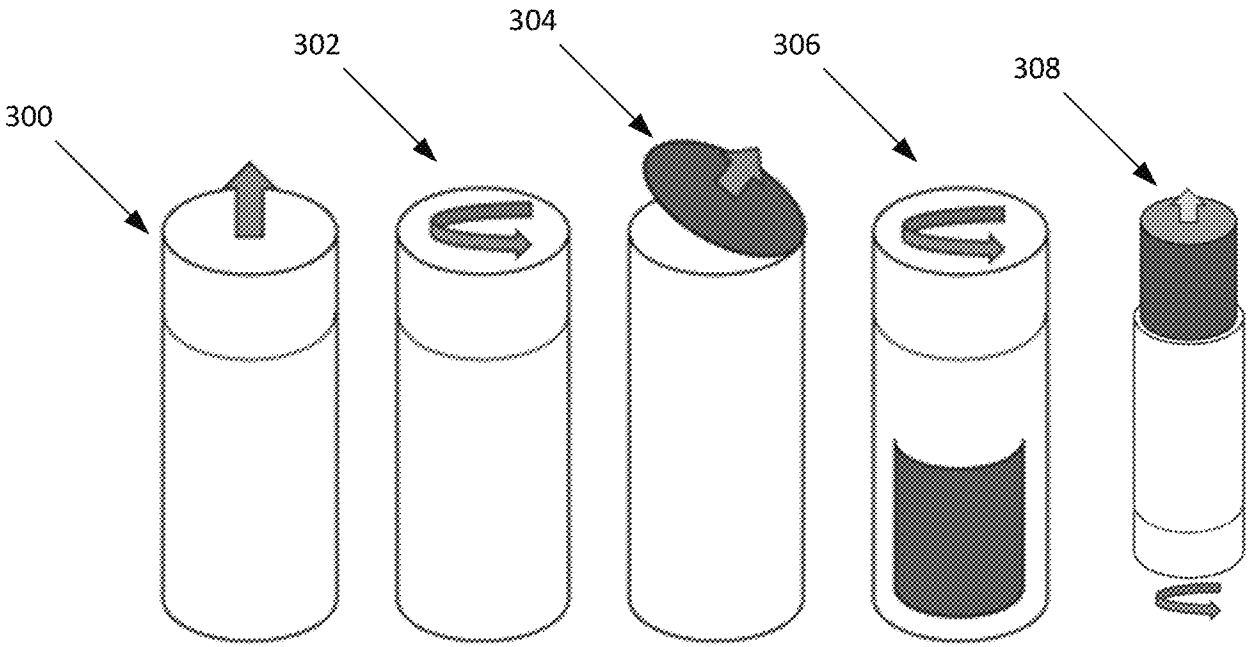
FIG. 3 illustrates various can opening methods in accordance with one embodiment.

FIG. 3 illustrates various methods for opening a can have a dowel shape 104. For example methods for opening a can having a dowel shape 104 may include a pop off tube top 300, a twist off tube top 302, a flip off tube top 304, a twist to open a side port 306, and/or a twist tube bottom to extend an opening 308.

Figure 4:
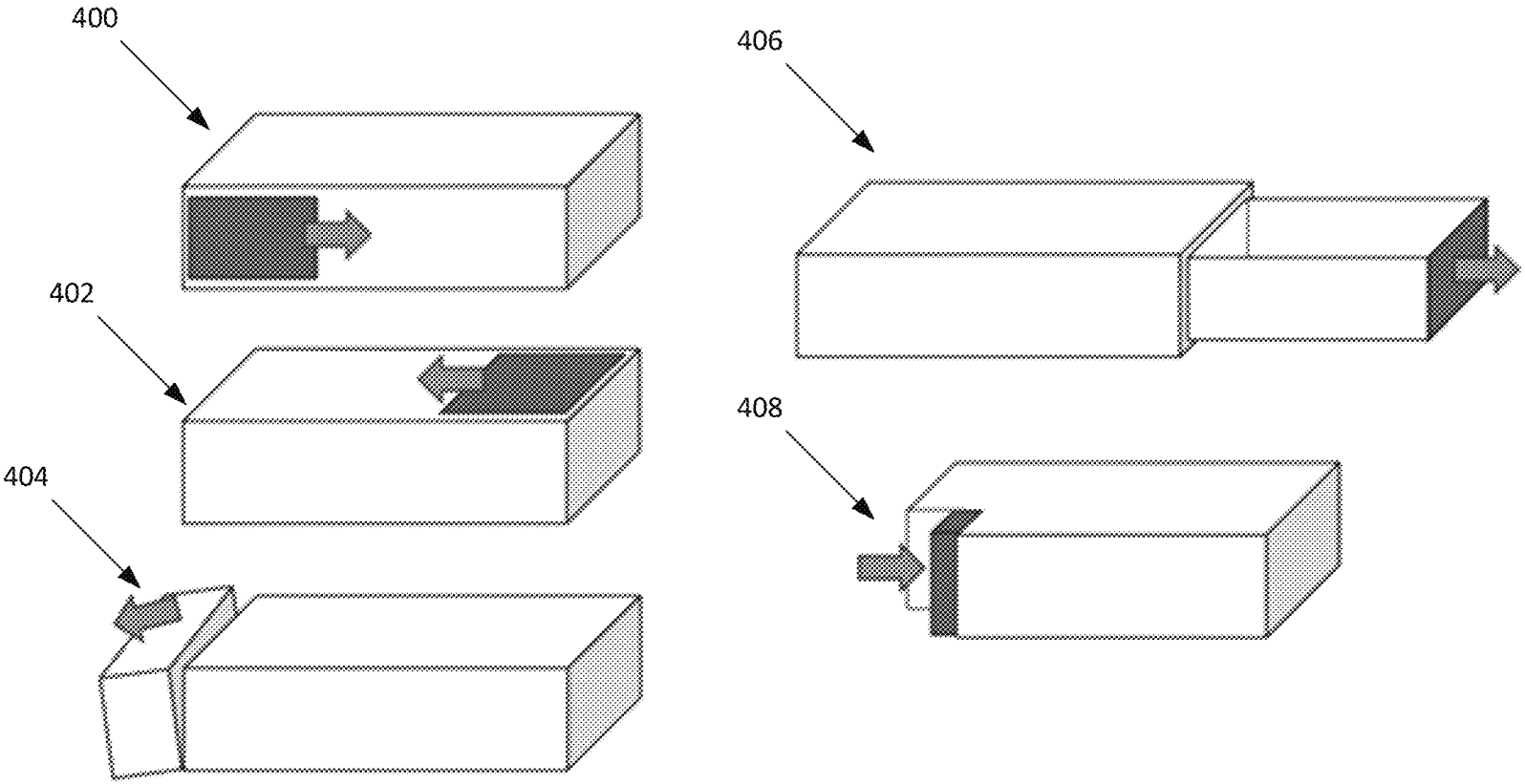
FIG. 4 illustrates various can opening methods in accordance with one embodiment.

FIG. 4 illustrates various methods for opening a can having a box shape 102. For example, methods for opening a can having a box shape 102 may include a box slider side open 400, a box slider top open 402, a box side breaks open 404, a box side extends open 406, and/or a box corner opens 406.

Figure 5:
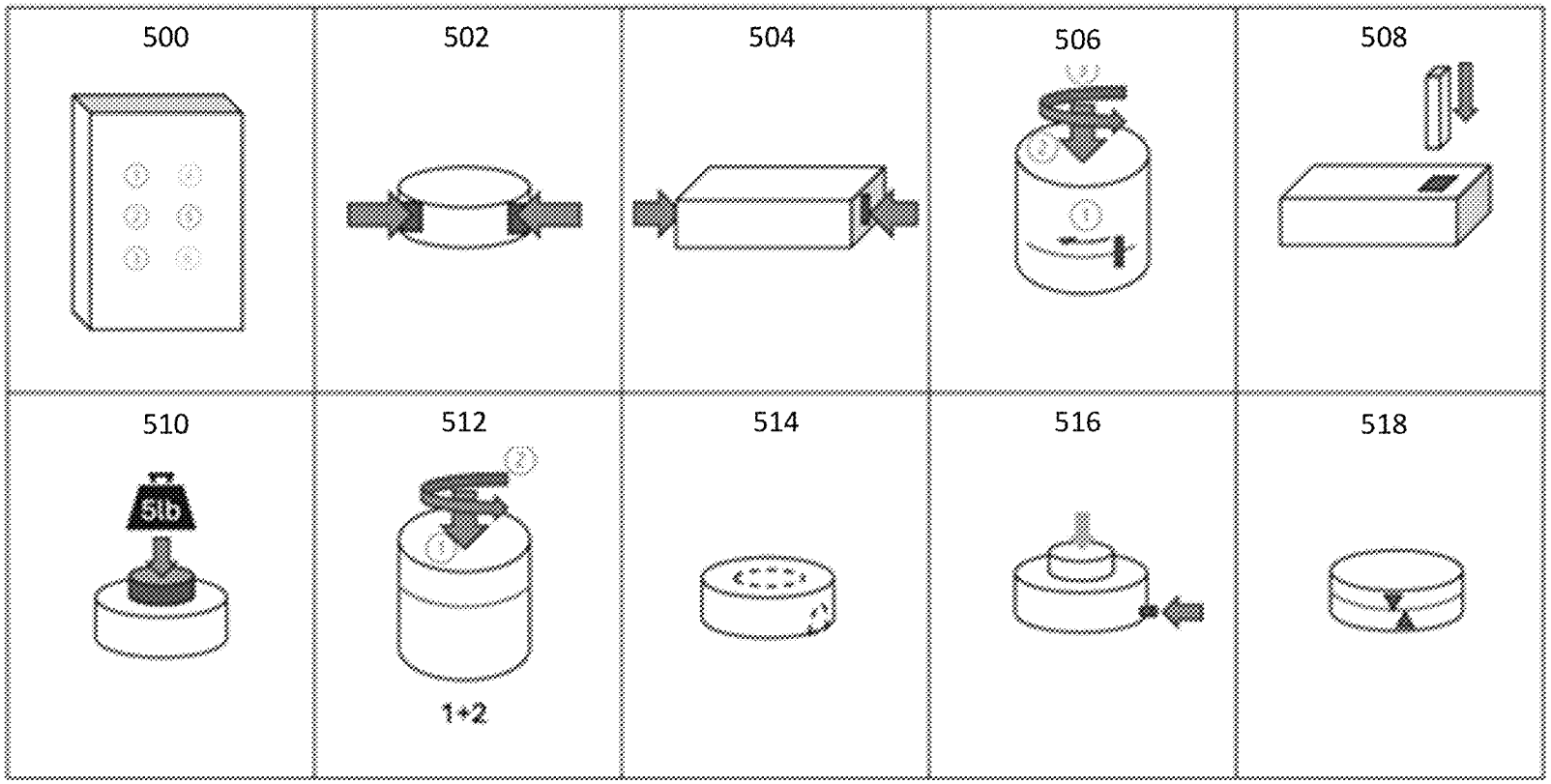
FIG. 5 illustrates various child-proofing and/or child-resistance methods in accordance with one embodiment.

FIG. 5 illustrates various methods for child-proofing a can or making it child-resistant. For example, a combination method 500 for childproofing (or child-resistance) may include requiring a user to press buttons or features in order for the can to open. In some examples, the combination method 500 may require a sequential order of pressed buttons or features to open a can. The correct combination of pressed buttons or features may release an opening mechanism. Another method for childproofing (or child-resistance) includes a dexterity/coordination method 502. The dexterity/coordination method 502 may include requiring a user to coordinate the pressing of buttons or features at various parts of the can. Dexterity and coordination may be required to actuate multiple mechanisms simultaneously. Another method for childproofing (or child-resistance) includes a hand size method 504. The hand size method 504 may require a user to have large enough hands to simultaneously press features at opposite ends of a can. The hand size method 504 requires large physiology to operate. Another method for childproofing (or child-resistance) includes a multi-step method 506. The multi-step method 506 may require a user to complete a variety of steps to open a can, such as a combination of a twist, press, and slider action in sequence. Another method for childproofing (or child-resistance) includes a tool/key method 508. The tool/key method 508 may required a user to use a tool or key to access the product. For example, the tool or key may be part of the can to be taken off by the user after purchase, or hang from the can to open the can. Another method for childproofing (or child-resistance) includes a strength method 510. The strength method 510 may require a user to exert enough force on a feature to open it, such that it would be unlikely for a child to be able to do the same. Another method for childproofing (or child-resistance) includes a complex motion method 512. The complex motion method 512 may require a user to press and twist the can in order to open the container. In some examples, the complex motion method 512 may require multiple steps occurring simultaneously requiring knowledge, strength, and dexterity. Another method for childproofing (or child-resistance) may include a hidden pressure points method 514. The hidden pressure points method 514 may require a user to read instructions on the can to determine how to open the can. The feature required to open the can may be hidden to the naked eye. The hidden feature may enable release or safety features and only be operable by knowledge gathering. Another method for childproofing (or child-resistance) may include a distraction method 516. The distraction method 516 may require a user to read instructions to actively ignore a feature that seems as if it would open the can, but actually actuate another feature to open the can. The distraction method 516 may include a hidden mechanism paired with a red herring mechanism, and be operable only be knowledge gathering. Another method for childproofing (or child-resistance) may include an alignment method 518. The alignment method 518 may require a user to align top and bottom pieces of a can in a certain way to open the can.

It will be appreciated that one or more of the childproofing (or child-resistance) methods illustrated in FIG. 5 may be used in the child-resistant cans described herein.

Provided herein are child-resistant cans. The child-resistant cans may be configured to contain one or more products. In some examples, the one or more products may include products that children should not have access to. For example, the one or more products may include dosage forms including an active ingredient. In some examples, the active ingredient may include one or more of nicotine, prescription pharmaceuticals, non-prescription pharmaceuticals, nutraceuticals, homeopathics, and/or cannabinoids.

FIG. 6A to FIG. 6M illustrate an embodiment of a child-resistant can 600. The child-resistant can 600 may include one or more safety mechanisms operable to prevent a child from opening the child-resistant can 600. For example, the child-resistant can 600 may require a complex motion, manipulation of hidden features, and/or adult strength in order to open the child-resistant can 600. In this manner, children are prevented from opening the child-resistant can 600.

The child-resistant can 600 may include a base 602 and a lid 610. The base 602 may include a bottom plate 604 and a base circumferential wall 616. The base circumferential wall 616 may extend from the bottom plate 604. For example, the base circumferential wall 616 may extend outwards from the bottom plate 604. The base 602 may include an interior surface 608 defined by the bottom plate 604 and the base circumferential wall 616. In some examples, the base 602 may further include an opposing exterior surface defined by the outside portions (e.g., not enclosed within the lid 610) of the bottom plate 604 and the base circumferential wall 616.

The lid 610 may be configured to enclose the interior surface 608. For example, the lid 610 may enclose the interior surface 608 such that a cavity is defined by the lid 610, interior surface 643, and optionally, the base circumferential wall 616. The cavity may be configured to contain one or more products 601.

The lid 610 may include a top plate 612 and a lid circumferential wall 614. The lid circumferential wall 614 may extend from the top plate 612. In some examples, the lid circumferential wall 614 may be configured to abut against the base circumferential wall 616. In some examples, the lid circumferential wall 614 may be configured to abut against the exterior surface of the base circumferential wall 616.

In some examples, the lid 610 may include at least one flex mechanism 628(*a*). The at least one flex mechanism 628(*a*) may extend outward from the lid circumferential wall 614 (e.g., the at least one flex mechanism 682(*a*) may be disposed on the exterior surface of the lid circumferential wall 614). The at least one flex mechanism 628(*a*) may include a projection 630 and a snap arm 632. The snap arm 632 may be moveable in relation to the projection 630. For example, the snap arm 632 may be configured to pivot between multiple positions with respect to the projection 630. For example, the snap arm 632 may have a natural state (e.g., FIGS. 6F and 6H) and a compressed state (e.g., FIG. 6G). In the natural state, the flex arm 632 may extend from the projection 630 and/or be biased at an angle upwards along the lid circumferential wall 614. In the compressed state, the flex arm 632 may be perpendicular to the projection 630. In some examples, the flex arm 632 naturally biases to the natural state. For example, the flex arm 632 may include a semi-flexible or semi-rigid material such that when a force is applied to the flex arm 632, the flex arm 632 is operable to transition to the compressed state. In the compressed state, the flex arm 632 may have stored energy, such that when the force applied to the flex arm 632 is removed, the flex arm 632 automatically transitions to the natural state.

In some examples, the natural state of the flex arm 632 may position the flex arm 632 at an angle from the projection 630. The angle may be measured in reference to horizontal axis defined by the top plate 612 of the lid 610 (e.g., the horizontal axis is on the same plane as the top plate 612 of the lid 610). In some examples, the angle of the flex arm 632 in the natural state may be about 10 degrees to about 20 degrees, about 20 degrees to about 30 degrees, about 30 degrees to about 40 degrees, about 40 degrees to about 50 degrees, about 50 degrees to about 60 degrees, or more. In some examples, in the compressed state, the flex arm 632 may extend perpendicularly to the projection 630 (e.g., the flex arm 632 may extend along the horizontal axis in the compressed state).

In some examples, the base circumferential wall 616 may include at least one groove 620(*a*). The at least one groove 620(*a*) may include a cut out within the base circumferential wall 616 (e.g., within the exterior surface of the base circumferential wall 616). In some examples, the at least one groove 620(*a*) may be molded as part of the base 602. In some examples, the at least one groove 620(*a*) may define a path (e.g., tortuous path) having one or more portions (e.g., sections). For example, the shape of the at least one groove 620(*a*) may define one or more motions necessary to remove the lid 610 from the base 602, as described further herein. In some examples, the at least one groove may have a square cross-section, a rectangular cross-section, or any other shape cross-section.

Figure 6A:
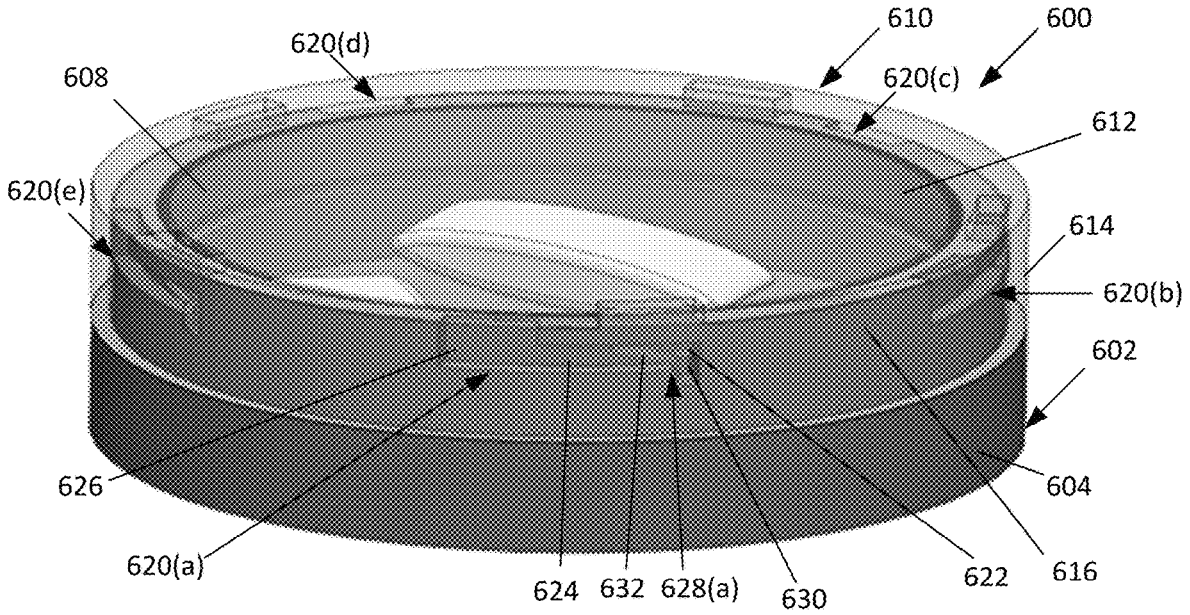
FIG. 6A illustrates a child-resistant can in accordance with one embodiment.

In some examples, as illustrated in FIG. 6A, the at least one groove 620(*a*) may include at least a first portion 622, a second portion 624, and a third portion 626. In some examples, the first portion 622, the second portion 624, and the third portion 626 may extend from one another in different directions. For example, the first portion 622 may connect to the second portion 624 at an angle. In some examples, the second portion 624 may connect to the third portion 626 at an angle. In some examples, the angles between the first portion 622 and the second portion 624 and the second portion and the third portion 626 may be about 90 degrees. In some examples, the angles may be about 10 degrees to about 20 degrees, about 20 degrees to about 30 degrees, about 30 degrees to about 40 degrees, about 40 degrees to about 50 degrees, about 50 degrees to about 60 degrees, about 60 degrees to about 70 degrees, about 70 degrees to about 80 degrees, about 80 degrees to about 90 degrees, about 90 degrees to about 100 degrees, about 100 degrees to about 110 degrees, about 110 degrees to about 120 degrees, about 120 degrees to about 130 degrees, about 130 degrees to about 140 degrees, about 140 degrees to about 150 degrees, about 150 degrees to about 160 degrees, or any combination therein.

Figure 6B:
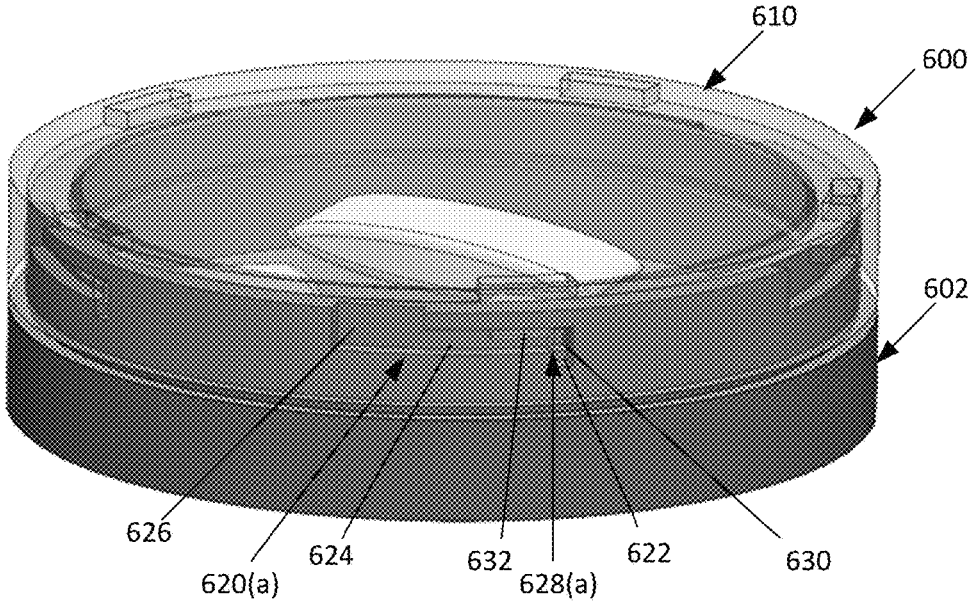
FIG. 6B illustrates a child-resistant can in accordance with one embodiment.
Figure 6C:
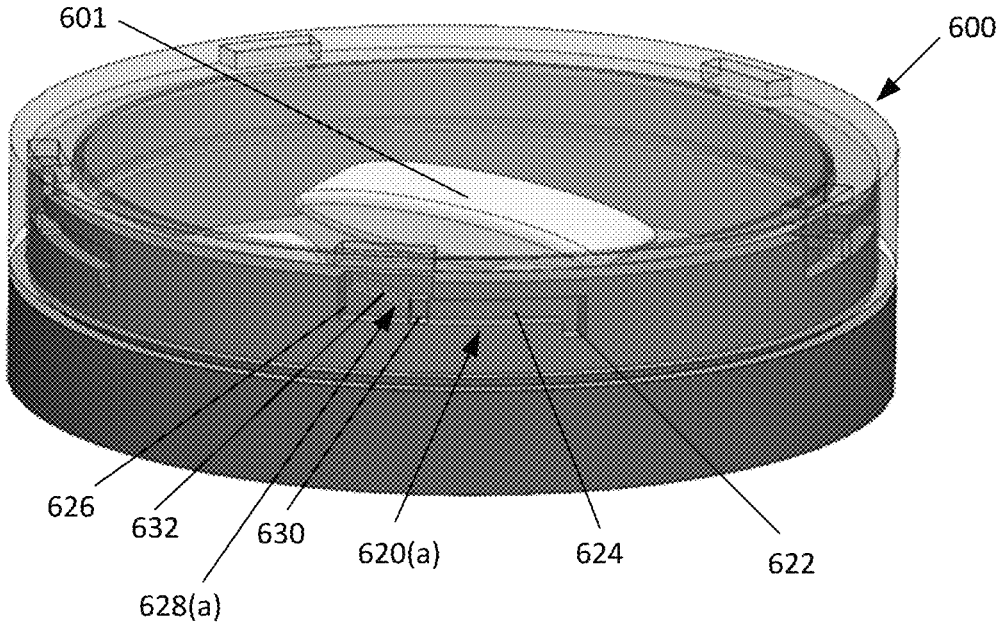
FIG. 6C illustrates a child-resistant can in accordance with one embodiment.
Figure 6D:
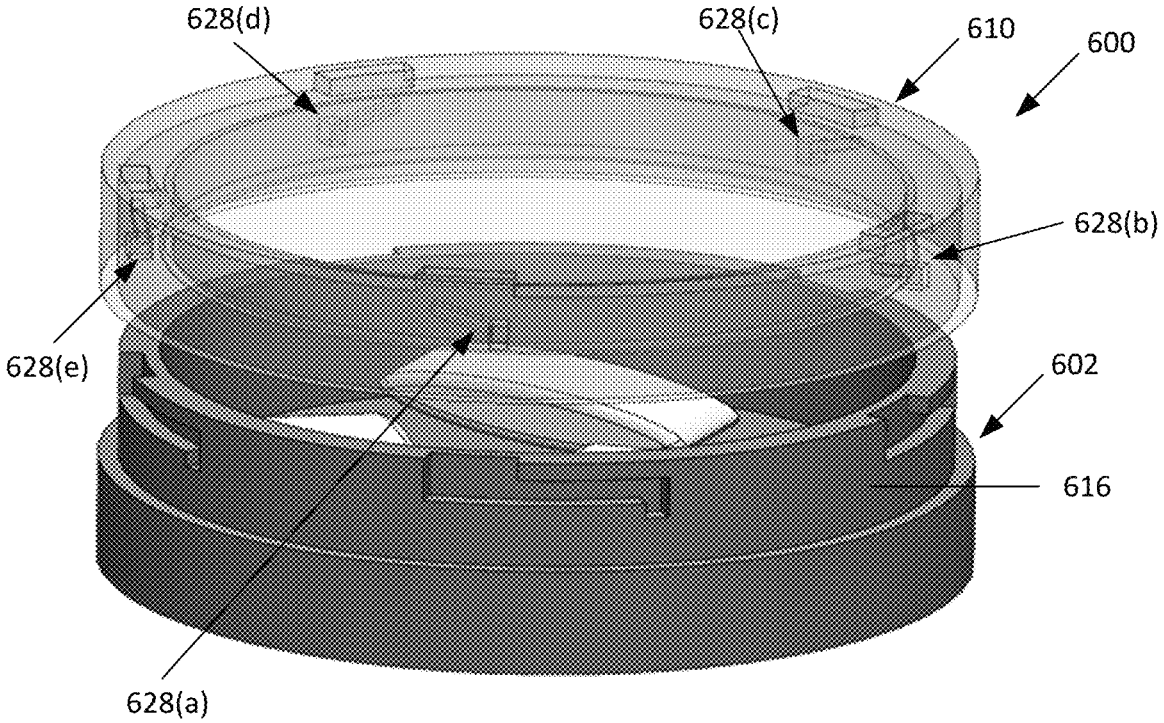
FIG. 6D illustrates a child-resistant can in accordance with one embodiment.
Figure 6E:
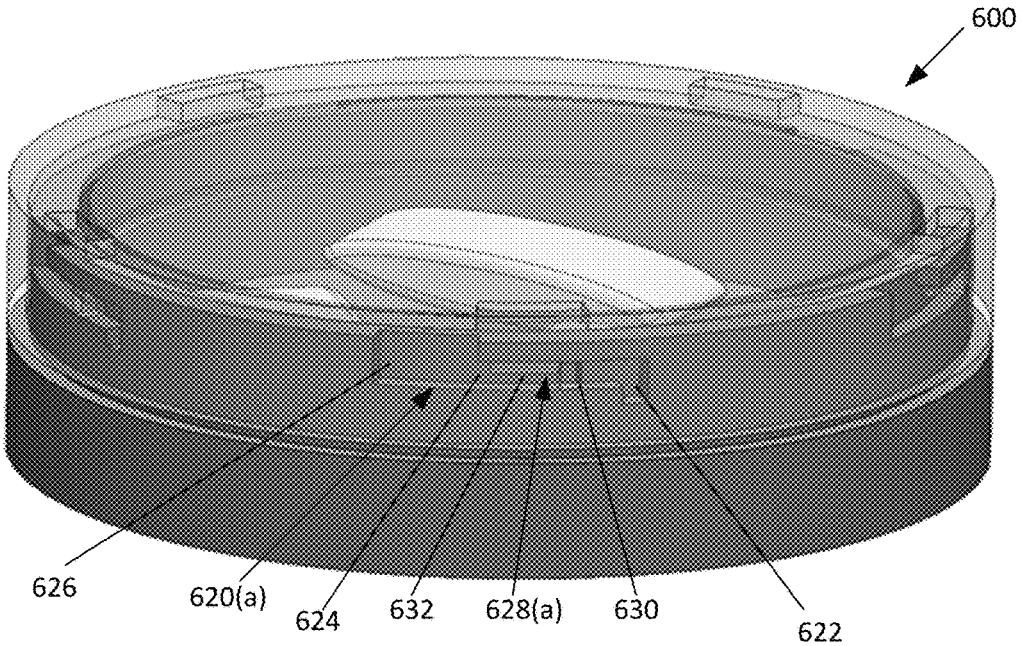
FIG. 6E illustrates a child-resistant can in accordance with one embodiment.

For example, as illustrated in FIG. 6A, the first portion 622 may be connected to the second portion 624 at a 90 degree angle. The second portion 624 may be connected to the third portion 626 at a 90 degree angle. In some examples, as illustrated in FIG. 6L, the first portion 622, the second portion 624, and the third portion 626 may form a screw-like shape. For example, the first portion 622 may be connected to the second portion 624 at an angle of about 100 to 120 degrees and the third portion 626 may be connected to the second portion 624 at an angle of about 60 to 80 degrees.

In other examples, the first portion 622, the second portion 624, and the third portion 626 may extend in different along the base circumferential wall 616 in different directions. While a first portion 622, a second portion 624, and a third portion 626 are shown, it will be appreciated that the at least one groove 620(*a*) may include more than three portions.

The at least one groove 620(*a*) may be configured to receive the at least one flex mechanism 628(*a*). For example, the at least one flex mechanism 628(*a*) may be inserted into the third portion 626 of the at least one groove 620(*a*). The lid 610 may then be rotated, thereby translating the at least one flex mechanism 628(*a*) along the second portion 624, as illustrated, for example, in FIG. 6E. In this position, the snap arm 632 of the flex mechanism 628(*a*) is in the compressed state. For example, the snap arm 632 is abutting against an upper portion of the at least one groove 620(*a*), thereby exerting a downward force on the lid 610 (e.g., the snap arm 632 stored energy in the compressed state pushes against the projection 630, thereby pushing the lid 610 downward towards the base 602). The "upper portion" of the groove may include a horizontal wall of the groove, such as an upper horizontal wall positioned upwards from a corresponding lower horizontal wall, a portion of the groove being defined between the upper and lower horizontal walls. In some embodiments, the upper portion may include at least a portion of an upper wall of the second portion of the groove. In this compressed state, the snap arm 632 may be configured to guide the at least one flex mechanism 628(*a*) towards the first portion 622. For example, the force provided by the flex arm 632 in the compressed state may include both a downward component (e.g., towards the bottom plate 604) and a horizontal component (e.g., in a direction opposite the direction the snap arm 632 extends from the projection 630, for example, a rightward or counterclockwise direction in FIG. 6E). In this manner, once the lid 610 is rotated such that the snap arm 632 is compressed against the upper portion of the at least one groove 620(*a*), the snap arm automatically biases (e.g., provides a force) the projection 630 towards the first portion 622. In some examples, once the projection 630 reaches a bottom surface (e.g., nearest the bottom plate 604) of the first portion 622, the snap arm 632 returns to the natural state, thereby locking the projection 630 into the first portion 622 and securing the lid 610 to the base 602. The snap arm 632 may provide a natural load on the projection 630, thereby securing the projection within the first portion 622.

In some examples, the first portion 622 may be considered a locking portion (e.g., the first portion 622 secures the projection 630 therein). The third portion 626 may be considered an inlet/outlet portion (e.g., the at least one flex arm 628(*a*) may be inserted and/or removed from the at least one groove 620(*a*) along the third portion 626).

In some examples, the first portion 622, the second portion 624, and the third portion 626 may have a depth. In some examples, the depth of the first portion 622, the second portion 624 and the third portion 626 may be about 0.8 millimeters (mm) to about 5 mm, about 1 mm to about 5 mm, about 2 mm to about 3 mm, or about 2 mm, or any combination therein. In some examples, the first portion 622 and the second portion 624 may have a width. The width of the first portion 622, the second portion 624, and the third portion 626 may be about 1 mm to about 5 mm, about 2 mm to about 3 mm, or about 2 mm, or any combination therein. In some examples, the width of the third portion 626 may be greater than the width of the first portion 622 and the second portion 624. For example, the width of the third portion 626 may be fixed such that the entirety at least one flex mechanism 628(*a*) fits therein when the snap arm 632 is in the natural state.

In some examples, the at least one groove 620(*a*) may include a plurality of grooves. For example, the at least one groove 620(*a*) may include two, three, four, five, six, seven, eight, nine, ten, or more grooves. In some examples, the at least one flex mechanism 628(*a*) may include a plurality of flex mechanisms. For example, the at least one flex mechanism 628(*a*) may include two, three, four, five, six, seven, eight, nine, ten, or more flex mechanisms. In some examples, the plurality of grooves may each be operable to receive one of the plurality of flex mechanisms. In some examples, the plurality of grooves may be evenly spaced about the base circumferential wall 616. In some examples, the plurality of flex mechanisms may be evenly spaced about the lid circumferential wall 614. In some examples, adding additional flex mechanisms and grooves increases the retention force of the lid 610 connection to the base 602.

Figure 6F:
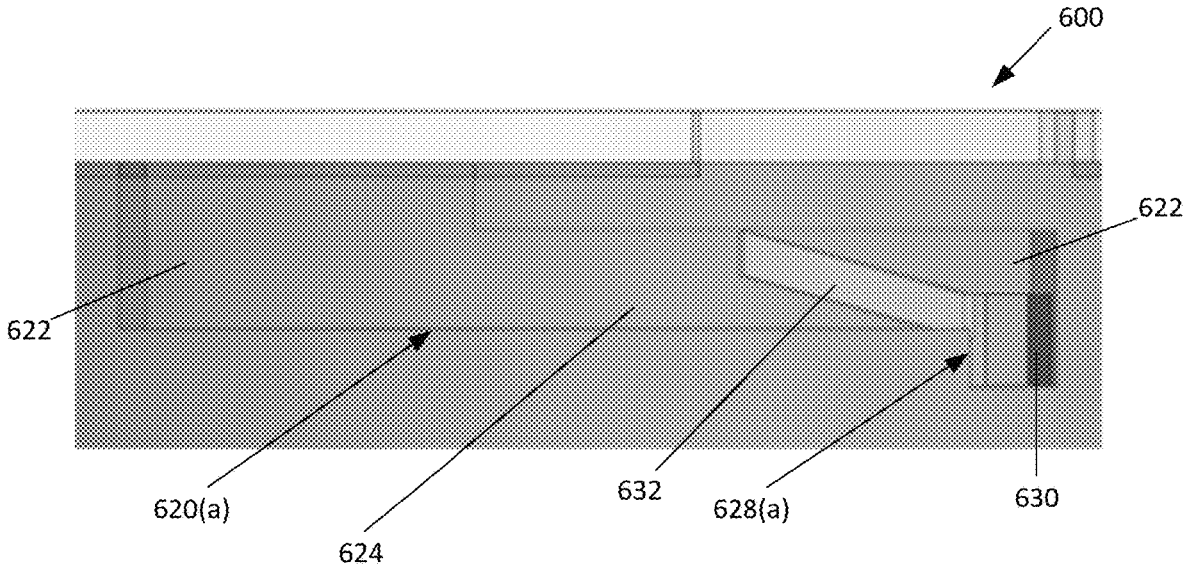
FIG. 6F illustrates a portion of a child-resistant can in accordance with one embodiment.
Figure 6G:
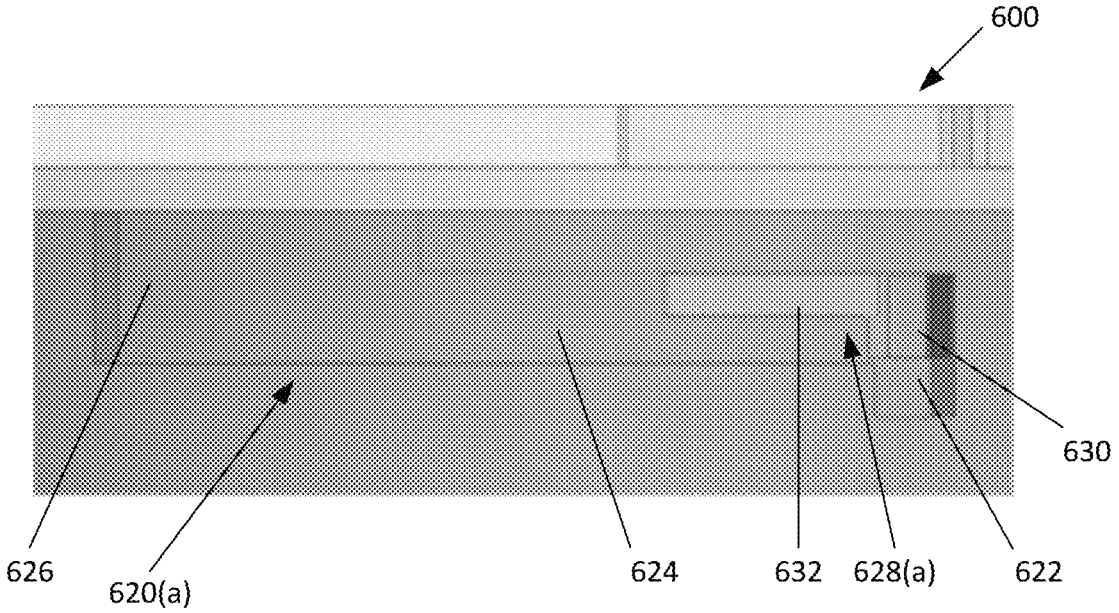
FIG. 6G illustrates a portion of a child-resistant can in accordance with one embodiment.
Figure 6H:
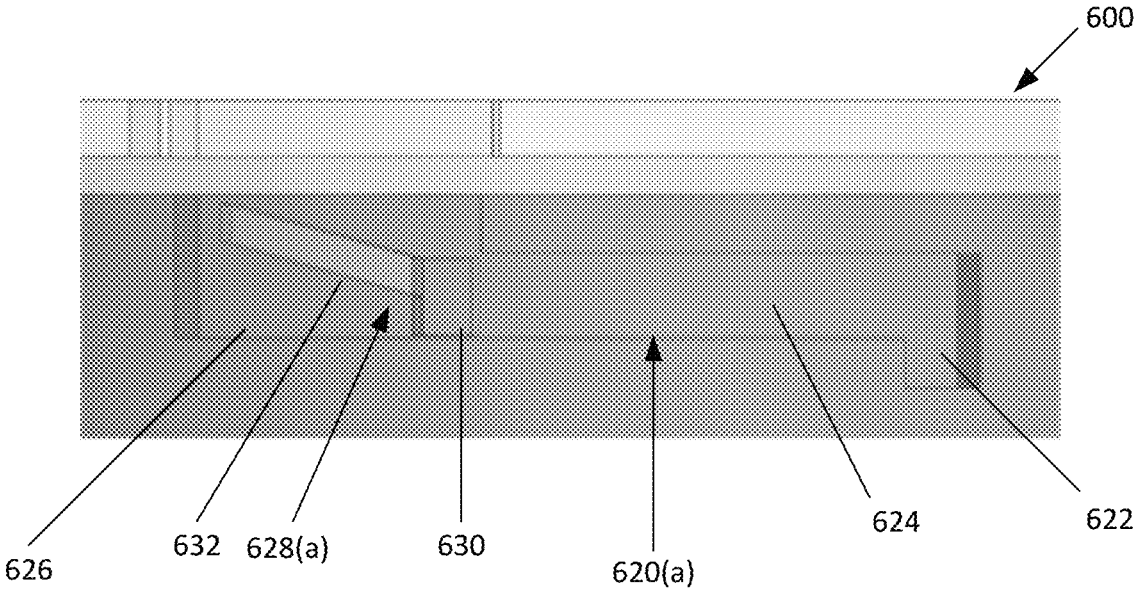
FIG. 6H illustrates a portion of a child-resistant can in accordance with one embodiment.
Figure 6I:
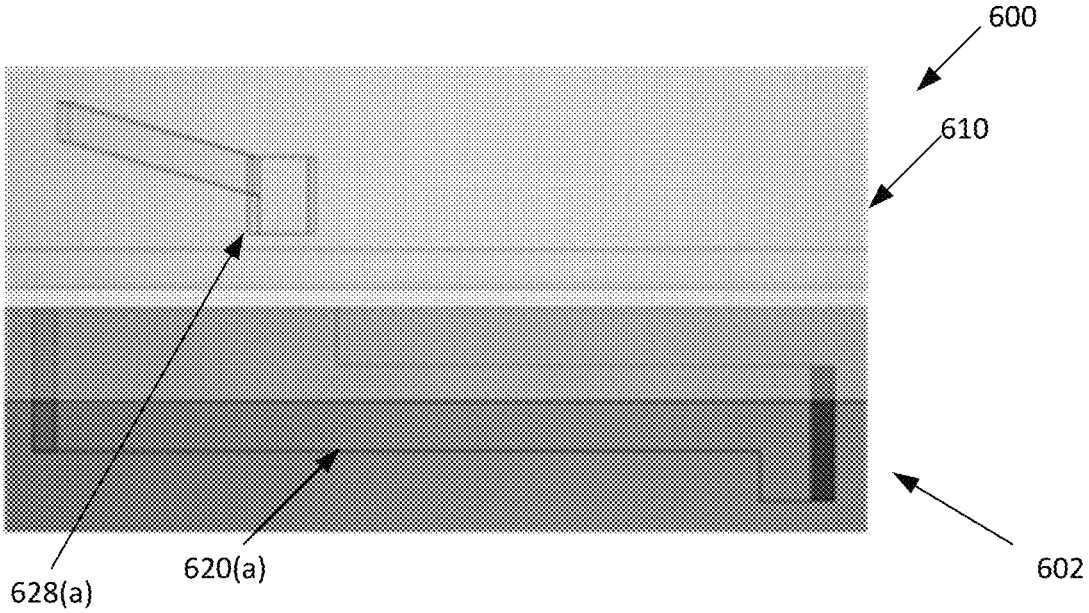
FIG. 6I illustrates a portion of a child-resistant can in accordance with one embodiment.
Figure 6J:
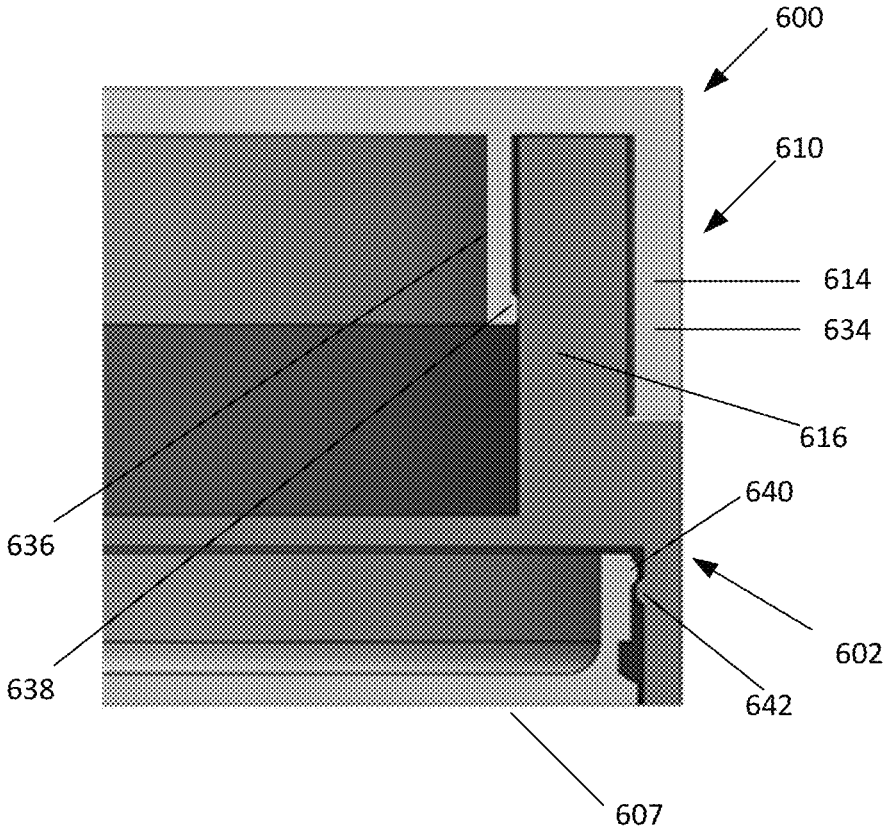
FIG. 6J illustrates a cross-section of a portion of a child-resistant can in accordance with one embodiment.
Figure 6K:
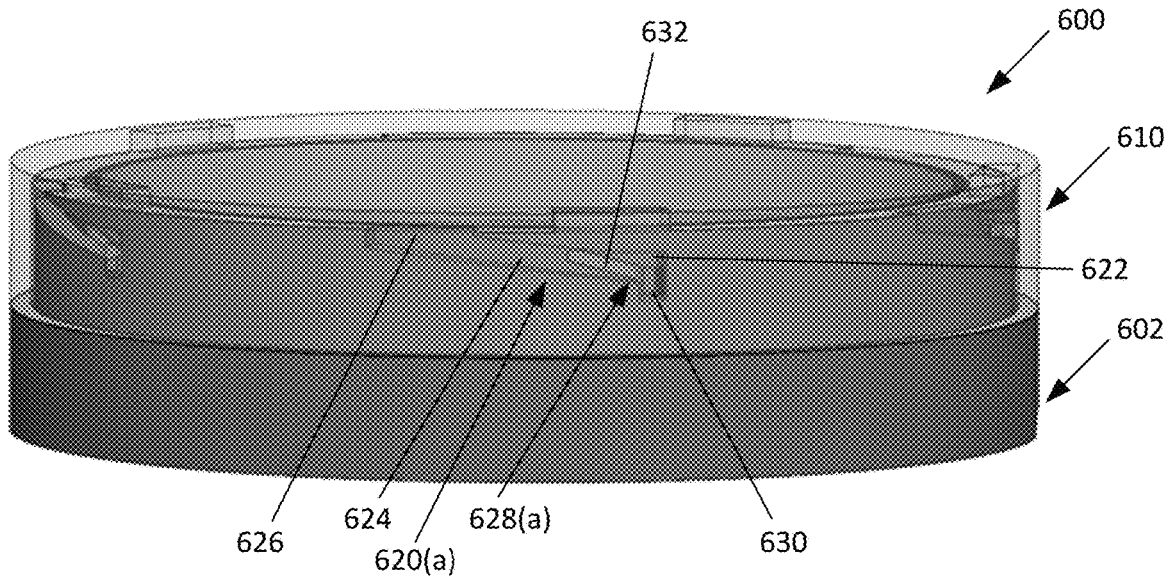
FIG. 6K illustrates a child-resistant can in accordance with one embodiment.
Figure 6L:
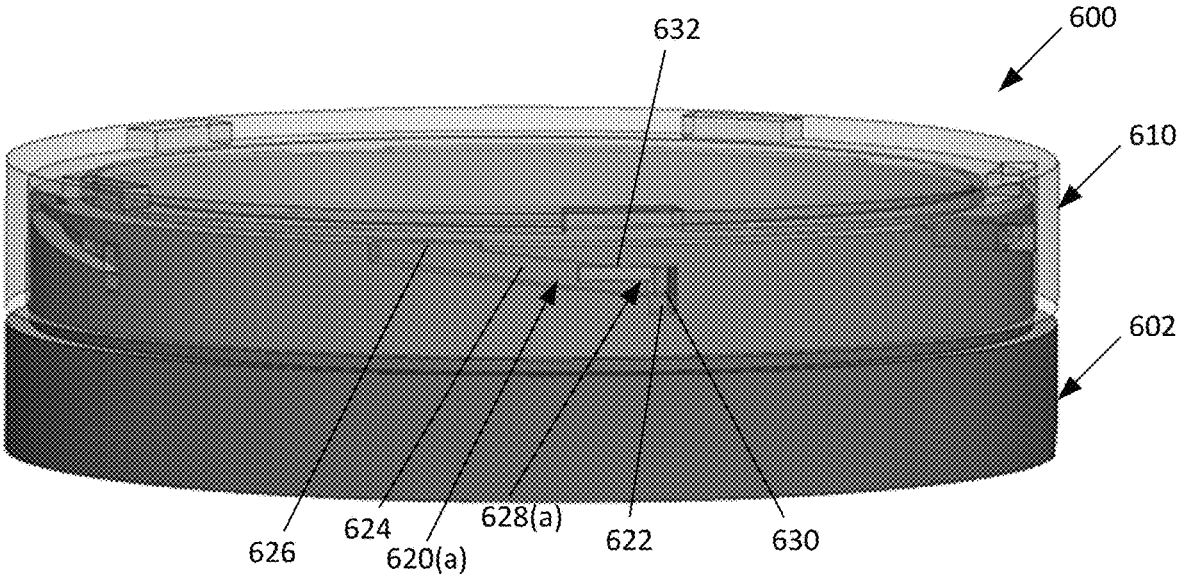
FIG. 6L illustrates a child-resistant can in accordance with one embodiment.
Figure 6M:
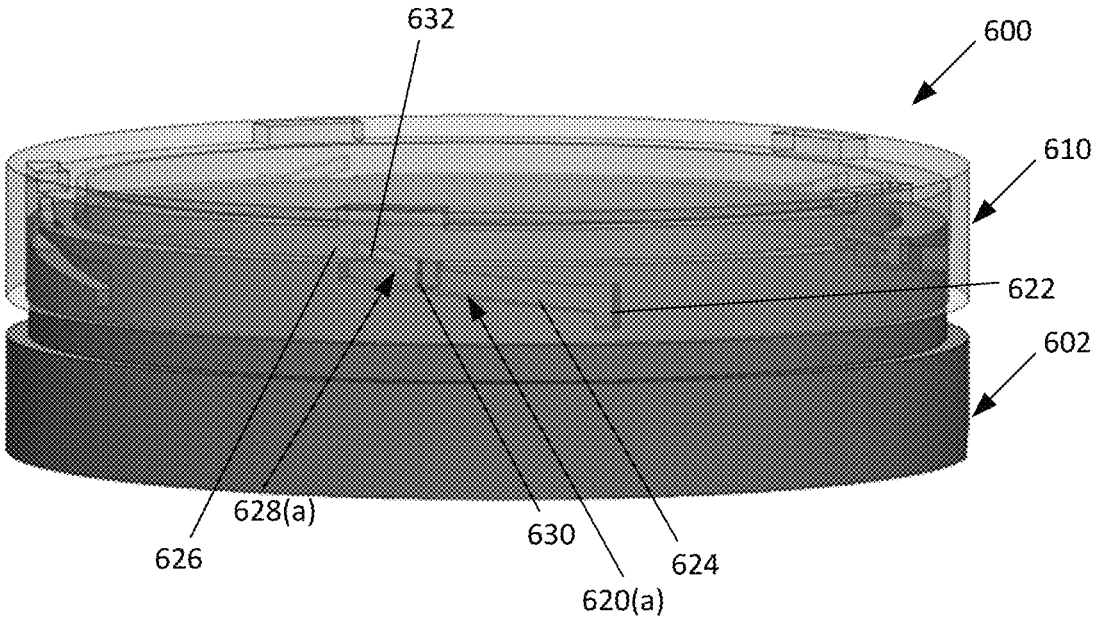
FIG. 6M illustrates a child-resistant can in accordance with one embodiment.

FIGS. 6A, 6F, and 6K illustrate the child-resistant can 600 with the lid 610 secured to the base 602. As illustrated, the snap arm 632 is in the natural state exerting load on the projection 630 to secure the projection 630 within the first portion. As illustrated in FIGS. 6B, 6G, and 6L, the lid 610 may be removed from the base 602 by lifting the lid 610 away from the base 602, thereby actuating the snap arm 632 to the compressed state. For example, the lid 610 must be lifted with sufficient force to overcome the downward force exerted by the snap arm 632. As illustrated in FIGS. 6C, 6H, and 6M, the lid 610 may then be rotated clockwise, thereby translating the at least one flex mechanism 628(*a*) along the second portion 624. Once the at least one flex mechanism 628(*a*) reaches the third portion 626, the snap arm 632 may return to the normal state as the upper portion of the at least one groove 620(*a*) no longer contacts the snap arm 632, as illustrated, for example, in FIGS. 6C, 6H, and 6M. The lid 610 may then be lifted upwards from the base 602 to remove the lid from the base 602, as illustrated, for example, in FIGS. 6D and 6I.

In some examples, the clockwise rotation of the lid 610 required to remove the lid from the base 602 may further aid in making the child-resistant can 600 child resistant, as rotating a lid 610 clockwise for removal is uncommon.

A user may recouple the lid 610 to the base 602 by first aligning the at least one flex mechanism 628(*a*) with the third portion 626. The user may then rotate the lid 610 counterclockwise such that the at least one flex mechanism 628(*a*) translates along the second portion 624. Once the projection 630 reaches the first portion 622, the stored energy from the snap arm 632 may push the projection 630 downwards, thereby securing the projection 630 in the first portion 622, returning the snap arm 632 to the natural state, and securing the lid 610 to the base 602. In some examples, once the projection 630 is secured in the first portion 622, the return of the snap arm 632 provides feedback to a user (e.g., tactile feedback in the form of a vibration or audible feedback in the form of a click noise).

FIG. 6J illustrates a cross-section of the child-resistant can 600. As illustrated, the lid circumferential wall 614 can include two portions configured to surround the base circumferential wall 616. For example, the lid circumferential wall 614 may include an outer wall 634 and an inner wall 636. In some examples, the inner wall 636 may include a sealing ring 638. The sealing ring 638 may be operable to abut against an interior surface of the base circumferential wall 616. In some examples, the sealing ring 638 may be operable to seal the cavity defined by the lid 610, the interior surface 608, and the base circumferential wall 616 such that the one or more products 601 contained within the cavity remain fresh, minimizes air and bacterial ingress, and maintains a vapor moisture barrier.

The child-resistant can 600 may further include a catch lid 607, as illustrated, for example, in FIG. 6J. In some examples, the catch lid 607 may include a projection 640 configured to interface with a projection 642 of the base 602 to secure the catch lid 607 to the base 602. In some examples, a cavity may be defined between the catch lid 607 and the bottom of the base 602. The cavity may be operable to hold objects (e.g., used products). In some examples, the catch lid 607 may include a lip. In some examples, the base 602 may include an opening in the bottom of the base such that the lip may be accessed by a user. In some examples, the user may remove the catch lid 607 from the base 602 by pulling the lip out of the opening, as will be described further herein in reference to other exemplary catch lids.

In some examples, as illustrated in FIG. 6M, the child-resistant can 600 may have a diameter. In some examples, the diameter may be about 50 mm to about 100 mm. In some examples, the diameter 656 may be about 50 mm to about 60 mm, about 60 mm to about 70 mm, about 70 mm to about 80 mm, about 80 mm to about 90 mm, or about 90 mm to about 100 mm. In some examples, the child-resistant can 600 may include a height. In some examples, the height 658 may be about 10 mm to about 30 mm. In some examples, the height may be about 10 mm to about 15 mm, about 15 mm to about 20 mm, about 20 mm to about 25 mm, or about 25 mm to about 30 mm.

Figure 7A:
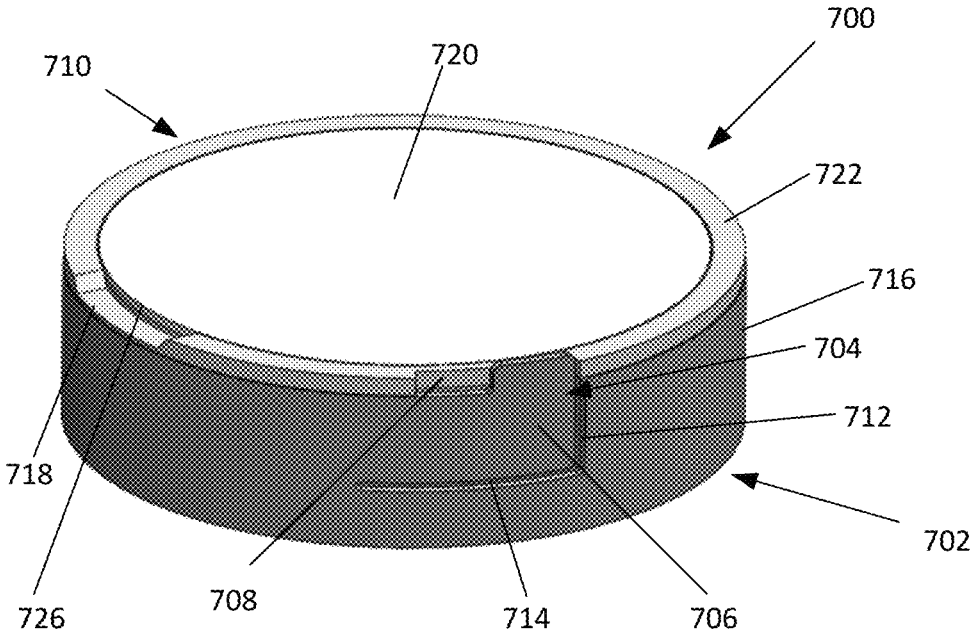
FIG. 7A illustrates a child-resistant can in accordance with one embodiment.
Figure 7B:
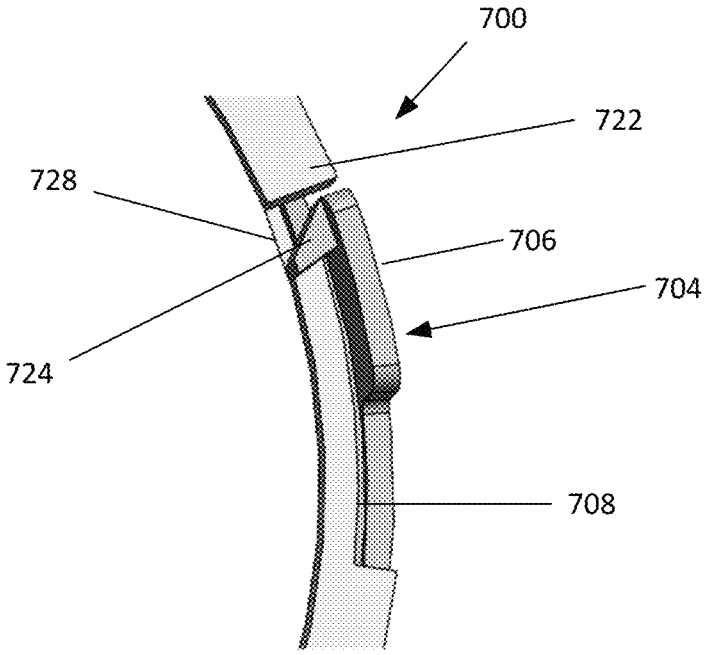
FIG. 7B illustrates a portion of a child-resistant can in accordance with one embodiment.
Figure 7C:
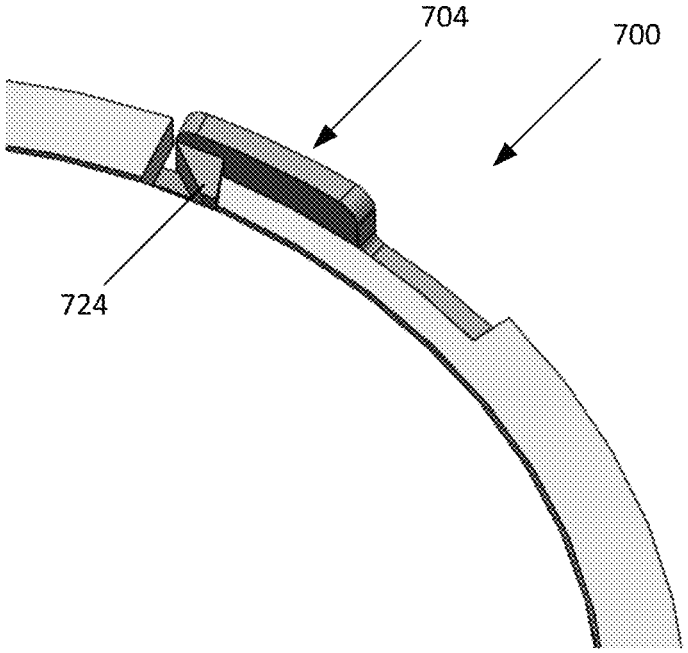
FIG. 7C illustrates a portion of a child-resistant can in accordance with one embodiment.
Figure 7D:
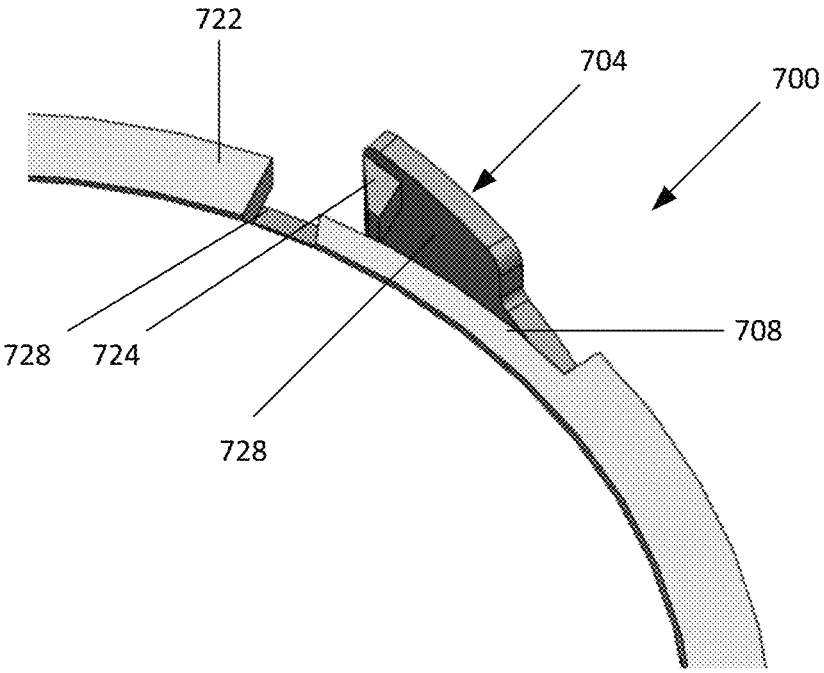
FIG. 7D illustrates a portion of a child-resistant can in accordance with one embodiment.
Figure 7E:
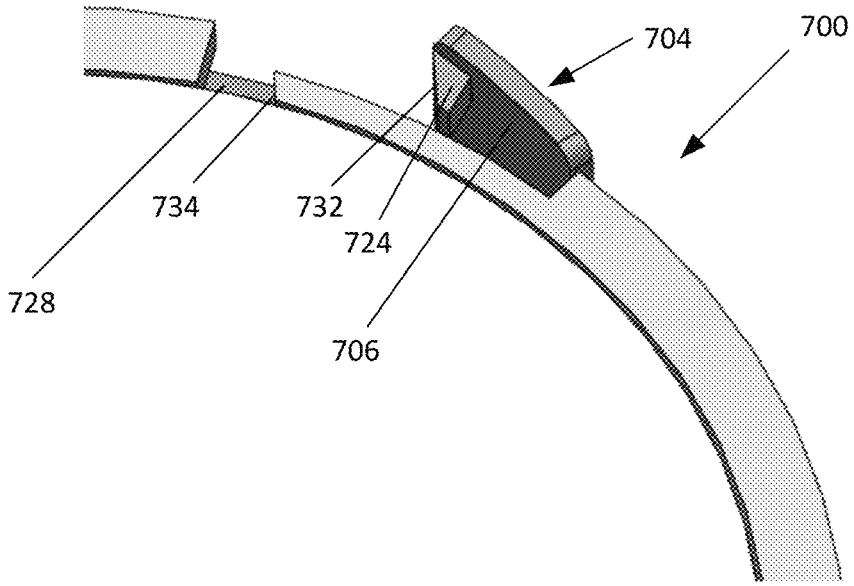
FIG. 7E illustrates a portion of a child-resistant can in accordance with one embodiment.
Figure 7F:
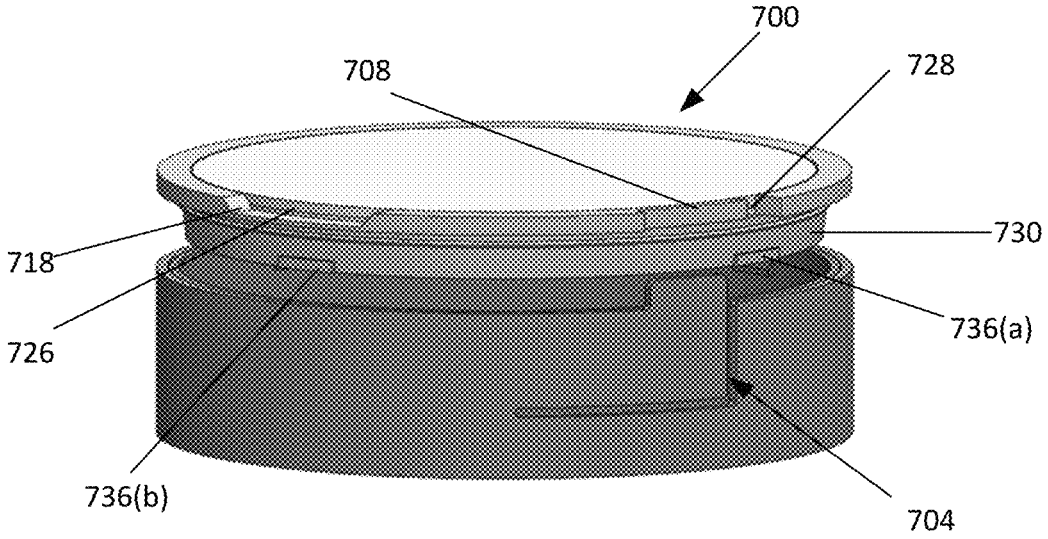
FIG. 7F illustrates a portion of a child-resistant can in accordance with one embodiment.
Figure 7G:
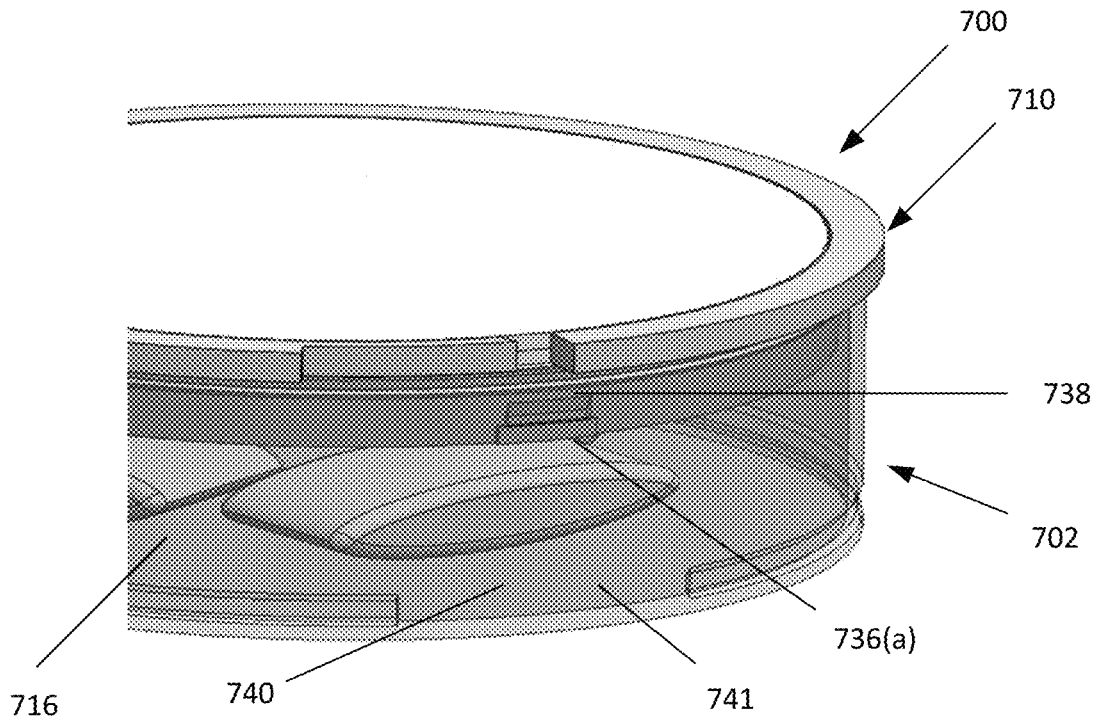
FIG. 7G illustrates a portion of a child-resistant can in accordance with one embodiment.
Figure 7H:
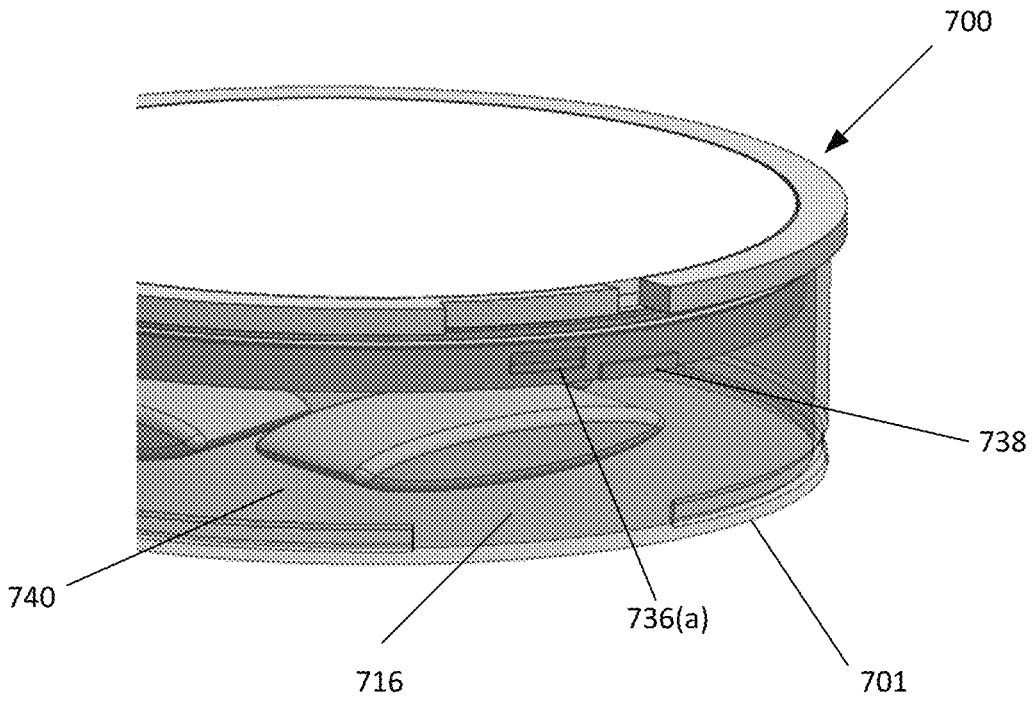
FIG. 7H illustrates a portion of a child-resistant can in accordance with one embodiment.
Figure 7I:
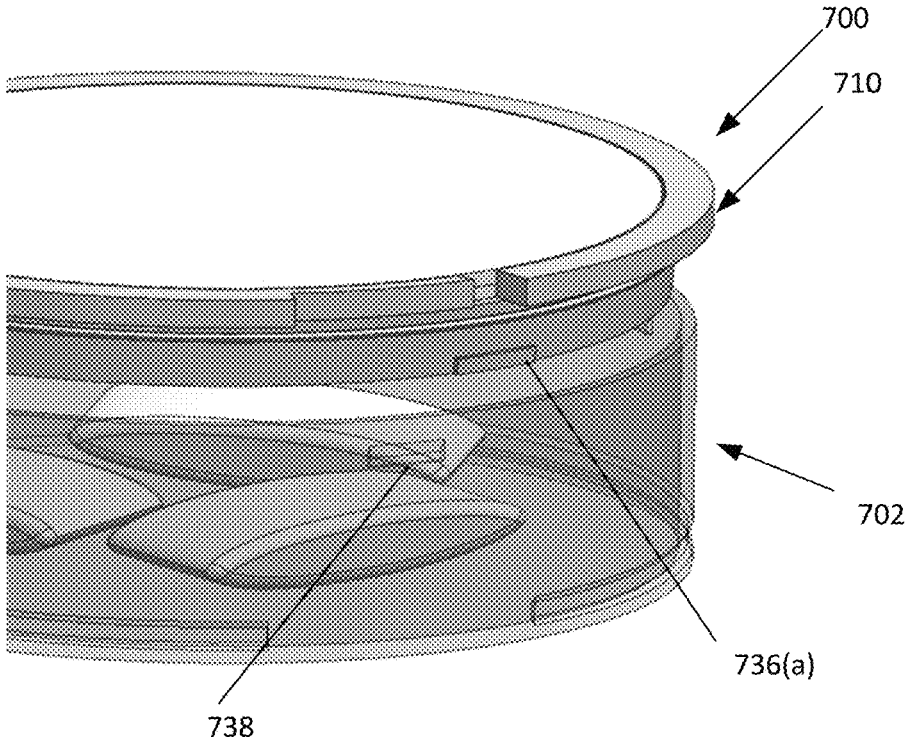
FIG. 7I illustrates a portion of a child-resistant can in accordance with one embodiment.
Figure 7J:
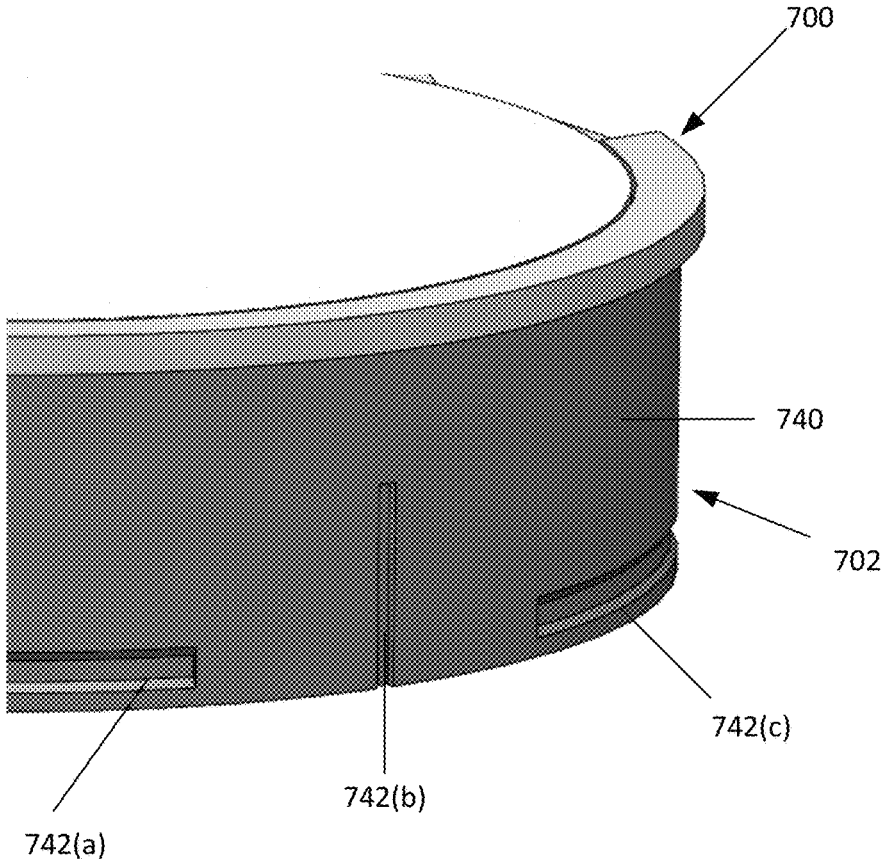
FIG. 7J illustrates a portion of a child-resistant can in accordance with one embodiment.
Figure 7K:
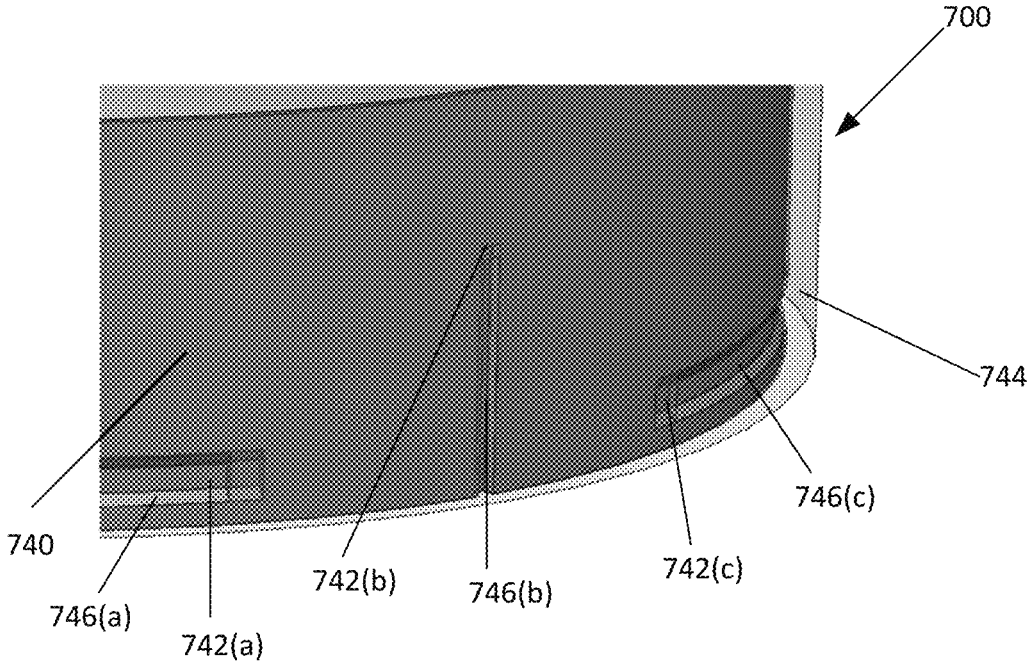
FIG. 7K illustrates a portion of a child-resistant can in accordance with one embodiment.
Figure 7L:
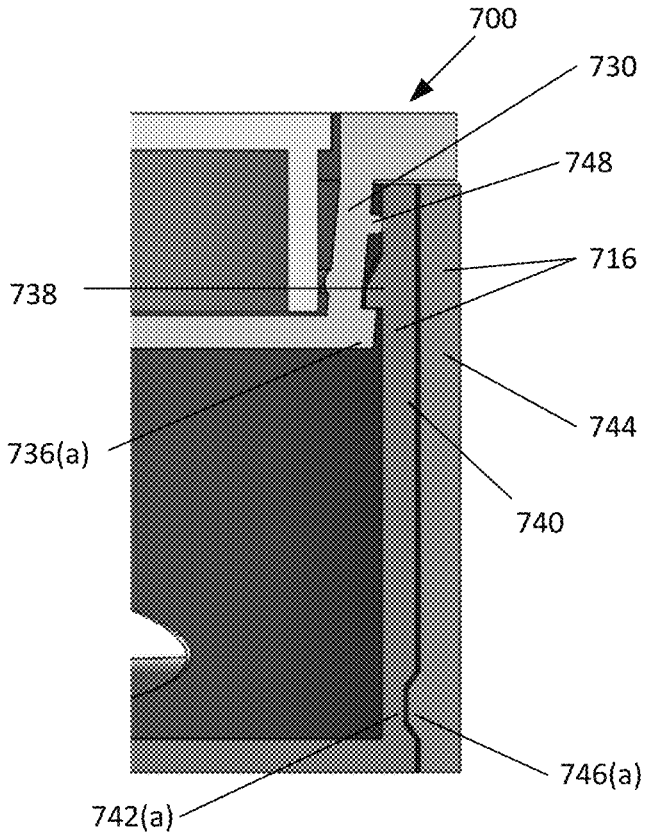
FIG. 7L illustrates a cross-section of a portion of a child-resistant can in accordance with one embodiment.
Figure 7M:
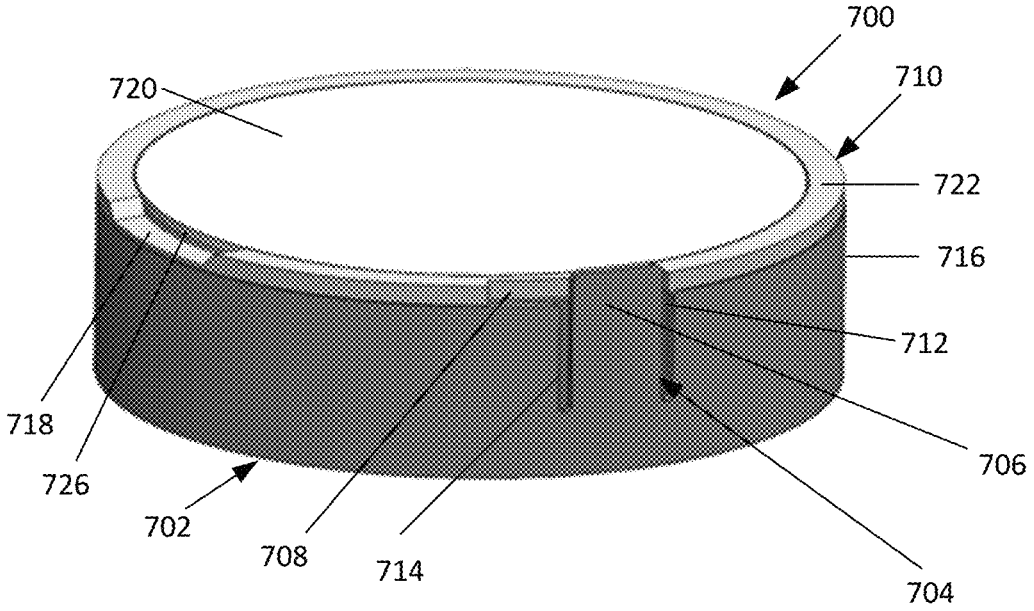
FIG. 7M illustrates a child-resistant can in accordance with one embodiment.
Figure 7N:
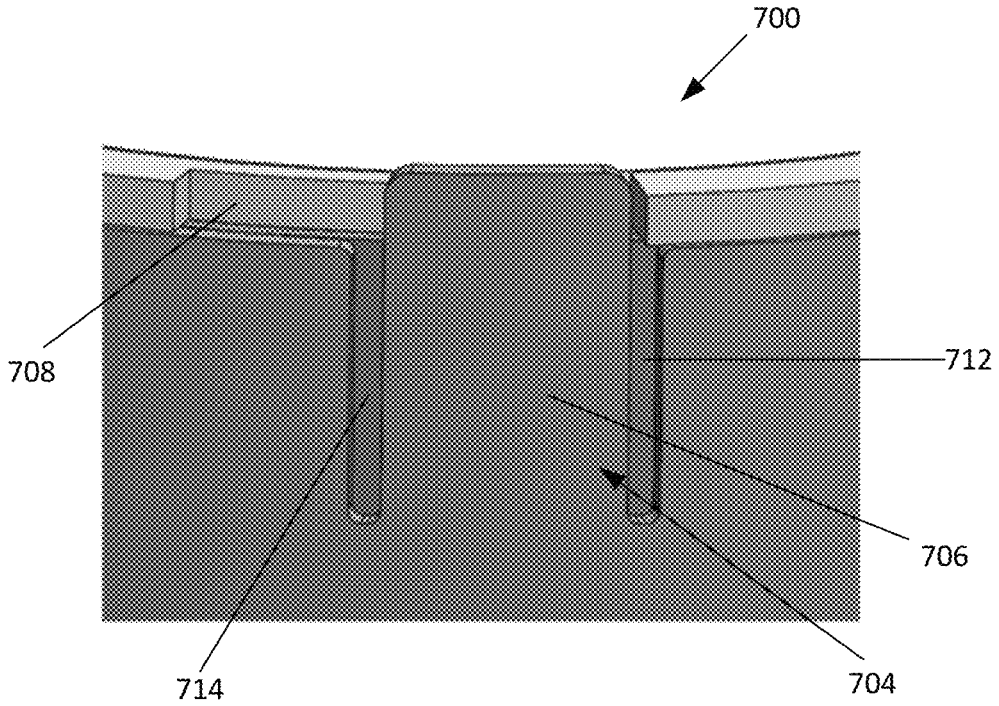
FIG. 7N illustrates a portion of a child-resistant can in accordance with one embodiment.
Figure 7O:
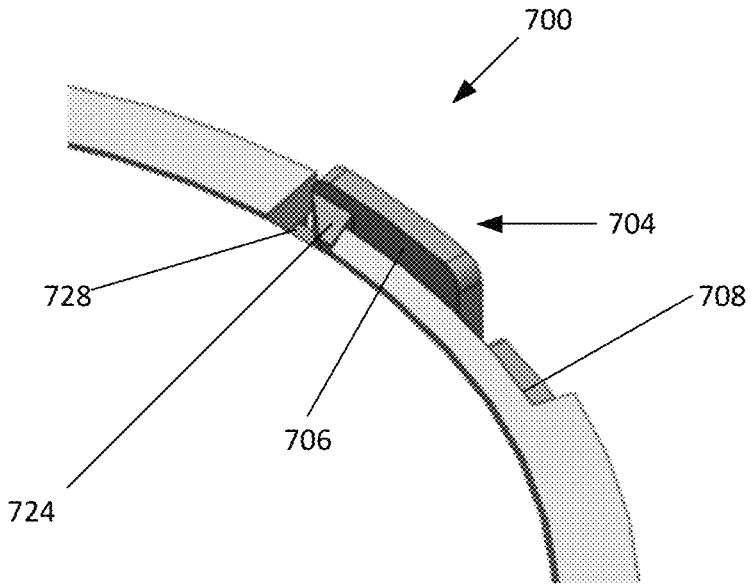
FIG. 7O illustrates a portion of a child-resistant can in accordance with one embodiment.
Figure 7P:
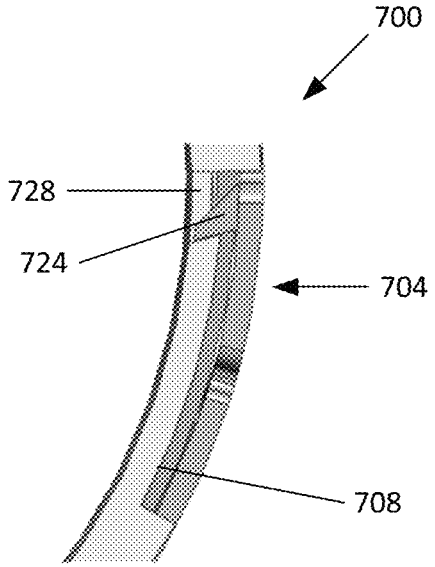
FIG. 7P illustrates a portion of a child-resistant can in accordance with one embodiment.

FIGS. 7A to 7P illustrate an embodiment of a child-resistant can 700. The child-resistant can 700 may include one or more safety mechanisms operable to prevent a child from opening the child-resistant can 700. For example, the child resistant can 700 may include a dexterity and coordination safety mechanism. In this manner, children are prevented from opening the child-resistant can 700.

The child-resistant can 700 may include a base 702 and a lid 710. The base 702 may include a bottom plate 701 and a base circumferential wall 716. In some examples, the base circumferential wall 716 may include an inner base circumferential wall 740 and an outer shell 744, as illustrated in FIG. 7L. The base circumferential wall 716 may extend from the bottom plate 701. In some examples, the base circumferential wall 716 and the bottom plate 701 may define an interior surface 741 and an opposing exterior surface. In some examples, the interior surface 741 may be operable to receive one or more objects (e.g., products described herein). In some examples, when the lid 710 is coupled to the base 702, a cavity for containing one of more objects may be defined by the lid 710, the interior surface 741, and the base circumferential wall 716.

The lid 710 may include a top plate 722 and a lid circumferential wall 730. The lid 710 may be configured to enclose the interior surface 741. The lid circumferential wall 730 may extend from the top plate 722. The lid circumferential wall 730 may be configured to abut against the base circumferential wall 716. For example, the lid circumferential wall 730 may be operable to abut against an interior surface of the base circumferential wall 716 (e.g., interior surface of inner base circumferential wall 740). In some examples, the top plate 722 may include at least one indent 708, such as at least 3 indents, at least 4 indents, or more. In some examples, the at least one indent 708 may include a recessed portion 728. In some examples, the recessed portion 728 may include an angled surface 734. In some examples, the angled surface 734 may have a taper of about 10 degrees to about 20 degrees, about 20 degrees to about 30 degrees, or about 30 degrees to about 40 degrees from an exterior side (e.g., outer side of the indent 708) to an interior side (e.g., inner side of the indent 708).

In some examples, the base circumferential wall 716 may include at least one snap-fit connector 704. The at least one snap-fit connector 704 may include a body 706 and a snap projection 724. The snap projection 724 may be configured to be secured within the recessed portion 728. In some examples, the snap projection 724 may have an angled surface 732. The angled surface 732 may be configured to aid in removal of the snap projection 724 from the recessed portion 728 (e.g., the angled surface 732 may allow for the snap projection 724 to be pulled out of the recessed portion 728 without having the snap projection abut against the edge of the top plate 722 defining the recessed portion 728).

In some examples, the at least one snap-fit connector 704 may be formed within the base circumferential wall 716 (e.g., outer shell 744). For example, the at least one snap-fit connector 704 may be formed by being connected at one end to the base circumferential wall 716 and having gaps 712, 714 surrounding the other portions of the at least one snap-fit connector 704. In some examples, an upper portion of the body 706 may be operable to be pulled outward from the base circumferential wall 716, such that the snap projection 724 may be removed from the recessed portion 728. FIGS. 7A and 7M illustrate two variations of the gaps 712, 714.

In some examples, the lid circumferential wall 730 may include at least one lid projection 736(*a*), 736(*b*). In some examples, the at least one lid projection 736(*a*), 736(*b*) may extend outward from the lid circumferential wall 730. In some examples, at least one of the at least one lid projections 736(*a*), 736(*b*) may be vertically aligned with the recessed portion 728, as illustrated, for example, in FIG. 7F.

In some examples, the base circumferential wall 716 may further include at least one base projection 738. The at least one base projection 738 may be vertically aligned with the snap projection 724. The at least one base projection 738 may be configured to abut against the at least one lip projection 736(*a*) such that lid 710 may not be removed while the snap projection is secured to the recessed portion 728. For example, to remove the lid 710, the snap projection 724 must first be removed from the recessed portion 728, then the lid 710 must be rotated to disengage the at least one lid projection 736(*a*) from the at least one base projection 738.

In some examples, the at least one lid projection 736(*a*) may include a plurality of lid projections evenly spaced about the lid circumferential wall 730. In some examples, the at least one base projection 738 may include a plurality of base projections evenly spaced about the base circumferential wall 716. In some examples, the plurality of base projections are operable to abut against the upper portions of the plurality of lid projections, thereby securing the lid 710 to the base 702 at a plurality of positions along the base circumferential wall 716, such that the lid 710 must be rotated (e.g., after actuating the snap-fit connector 704) to be removed from the base 702.

FIGS. 7A and 7M illustrate the lid 710 coupled to the base 702. To remove the lid 710 from the base 702, a user may first pull the at least one snap-fit connector 704 outward, thereby disengaging the snap projection 724 from the recessed portion 728, as illustrated, for example, in FIG. 7D. The user may then rotate the lid 710 such that the snap projection travels along the indent 708 away from the recessed portion 728, as illustrated in FIG. 7E. By rotating the lid 710, the at least one lid projection 736(*a*) may be disengaged from the at least one base projection 738. Once the at least one lid projection 736(*a*) is disengaged from the at least one lid projection 738, the lid 710 may be lifted away from the base 702 thereby uncoupling the lid 710 from the base 702.

In some examples, the recouple the lid 710 to the base 702, the an end of the indent 708 opposite from the recessed portion 728 is first aligned with the snap projection 724. The lid 710 is then pressed downward towards the base 702 such that the snap projection 724 is within the indent 708. The lid 710 is then rotated such that an upper portion the at least one lid projection 736(*a*) abuts against and is secured by the at least one base projection 738 and the snap projection 724 is secured within the recessed portion 728. In some examples, when the snap projection 724 is secured within the recessed portion 728, an indication that the lid 710 is secured to the base 702 may be provided to the user. In some examples, the indication may be visual (e.g., visually seeing the snap projection 724 within the recessed portion 728), audible (e.g., the snap projection 724 may make a clicking noise when the snap projection is secured in the recessed portion 728), and/or tactile (e.g., the child-resistant can 700 may vibrate when the snap projection 724 snaps into place in the recessed portion 728).

In some examples, the child-resistant can 700 may further include a catch lid 720. The catch lid 720 may be secured to the lid 710 similar to how the catch lid 607 is secured to the base 602 in child-resistant can 600. In some examples, the catch lid 720 may be removed from the lid 710 by pulling on a lip 726 exposed by an opening 718 in the top plate 722. In some examples, the catch lid 720 and the lid 710 may define a cavity operable to store objects (e.g., used products).

In some examples, as illustrated in FIG. 7L, the lid circumferential wall 730 may include a sealing ring 748. In some examples, the sealing ring 748 may be operable to seal the cavity defined by the lid 710, the interior surface 741, and the base circumferential wall 716 such that the one or more products contained within the cavity remain fresh, minimize air and bacterial ingress, by maintaining a vapor moisture barrier.

In some examples, when the base circumferential wall 716 includes an inner base circumferential wall 740 and an outer shell 744, the outer shell 744 may include one or more projections 746(*a*), 746(*b*), 746(*c*). In some examples, the one or more projections 746(*a*), 746(*b*), 746(*c*) may be configured to snap into place in corresponding grooves 742(*a*), 742(*b*), 742(*c*) of the inner base circumferential wall 740, thereby securing the outer shell 744 to the inner base circumferential wall 740, as illustrated, for example, in FIGS. 7K and 7L.

In some examples, the child-resistant can 700 may have a diameter. In some examples, the diameter may be about 50 mm to about 100 mm. The diameter may be about 50 mm to about 60 mm, about 60 mm to about 70 mm, about 70 mm to about 80 mm, about 80 mm to about 90 mm, or about 90 mm to about 100 mm, or any combination therein. In some examples, the child-resistant can 700 may have a height. In some examples, the height may be about 10 mm to about 30 mm. In some examples, the height may be about 10 mm to about 15 mm, about 15 mm to about 20 mm, about 20 mm to about 25 mm, or about 25 mm to about 30 mm, or any combination therein. In some examples, the at least one snap fit connector 704 may have a width. The width may be about 10 mm to about 20 mm, about 12 mm to about 17 mm, or about 15 mm.

FIGS. 8A to 8D illustrate an embodiment of a child-resistant can 800. The child-resistant can 800 may include one or more safety mechanisms operable to prevent a child from opening the child-resistant can 800. For example, the child-resistant can 800 may require dexterity, coordination, and strength in order to open the child-resistant can 800. In this manner, children are prevented from opening the child-resistant can 800.

The child-resistant can 800 may include a base 802 and a lid 810. The base 802 may include bottom plate 803. The base 802 may further include a base circumferential wall 812 extending from the bottom plate 803. In some examples, the bottom plate 803 and the base circumferential wall 812 may define an interior surface 801 and an opposing exterior surface. In some examples, the base circumferential wall 812 may include at least one exterior base projection 808 extending outward from the base circumferential wall 812 (e.g., out from the exterior surface). The base circumferential wall 812 may include at least one interior base projection 830 extending inward from the base circumferential wall 812.

The lid 810 may include a top plate 822. The lid 810 may further include a lid circumferential wall 826 extending downward from the top plate 822. In some examples, the lid circumferential wall 826 may be configured to abut against the base circumferential wall 812, thereby forming a cavity between the lid 810 and the base 802. The cavity may be operable to contain one or more products. In some examples, the lid circumferential wall 826 may further include at least one lid projection 828. In some examples, the upper portion of the at least one lid projection 828 may be secured by the at least one base projection 830 when the lid 810 is coupled to the base 802.

In some examples, the lid 810 may further include at least one snap-fit connector 804. The at least one snap-fit connector 804 may extend from the top plate 822 outside of the lid circumferential wall 826. In some examples, the at least one snap-fit connector 804 may include a body 805 having a hole 806. According to the present disclosure, the hole 806 may extend entirely through or only partially through the snap-fit connector. In some examples, the hole 806 may be operable to receive the at least one exterior base projection 808. The at least one snap-fit connector 804 may be received within a recess 820 of the base circumferential wall 812 when the lid 810 is coupled to the base 802. The at least one snap-fit connector 804 may be configured to be pulled out of the recess 820 (e.g., a user may pull the lower end of the at least one snap-fit connector 804 out of the recess 820, thereby disengaging the at least one exterior base projection 808 from the hole 806).

In some examples, the at least one base interior projection 830 may be on an opposite side of the base circumferential wall 812 from the at least one exterior base projection 808 (e.g., evenly spaced about a circumference of the base circumferential wall 812). In some examples, that at least one lid projection 828 may be on an opposite side of the lid circumferential wall 826 from the at least one snap-fit connector 804 (e.g., evenly spaced about a circumference of the lid circumferential wall 826). In this manner, the at least one snap-fit connector 804 and the at least one exterior projection 808 may secure one side of the lid 810 to the base 802, while the at least one base interior projection 830 and the at least one lid projection 828 may be secured the opposite side of the lid 810 to the base 802.

In some examples, the at least one exterior base projection 808 may include a plurality of exterior base projections. For example, the plurality of exterior base projections may include 1, 2, 3, 4, 5, or more exterior base projections. In some examples, the at least one lid projection 828 may include a plurality of corresponding lid projections. For example the plurality of corresponding lid projections may include 1, 2, 3, 4, 5, or more lid projections. In some examples, the plurality of exterior base projections may be evenly spaced about the base circumferential wall 812. In some examples, the plurality of lid projections may be evenly spaced about the lid circumferential wall 826.

In some examples, the at least one snap-fit connector 804 may include a plurality of at snap-fit connectors. For example, the at least one snap-fit connectors 804 may include 2 snap fit connectors such that a user may have to have a sufficient hand size to actuate both snap-fit connectors at one time. In some examples, the at least one exterior base projection 808 may include a corresponding number of exterior base projections configured to be engaged to the snap-fit connectors.

Figure 8A:
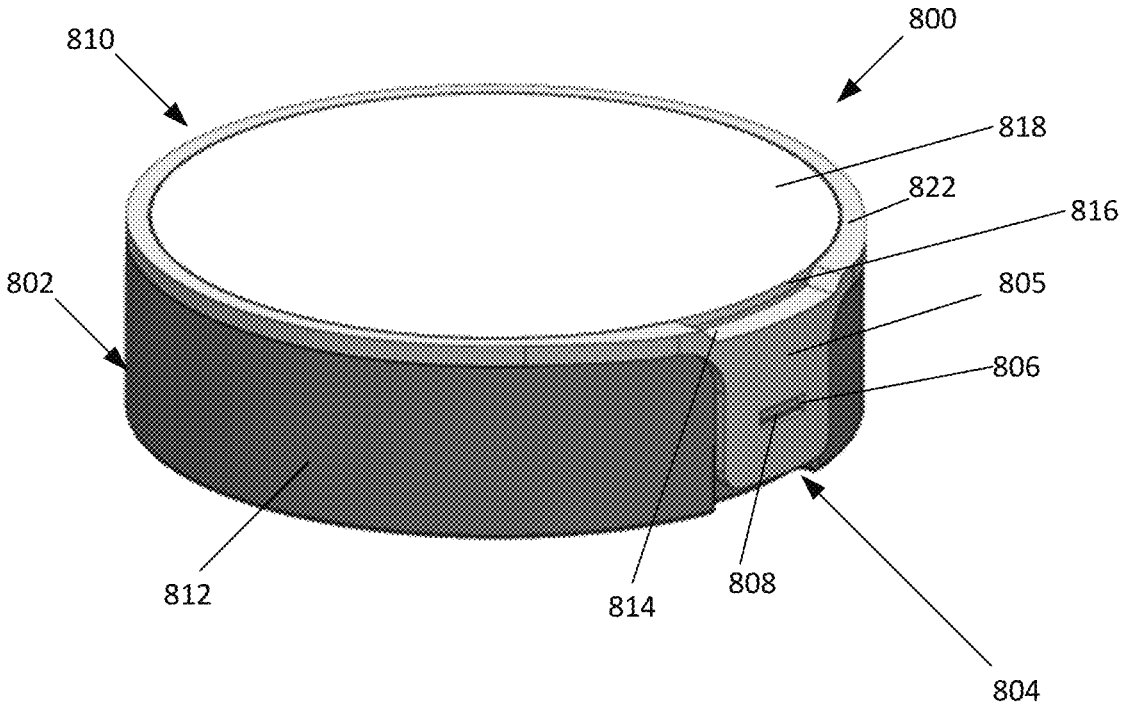
FIG. 8A illustrates a child-resistant can in accordance with one embodiment.
Figure 8B:
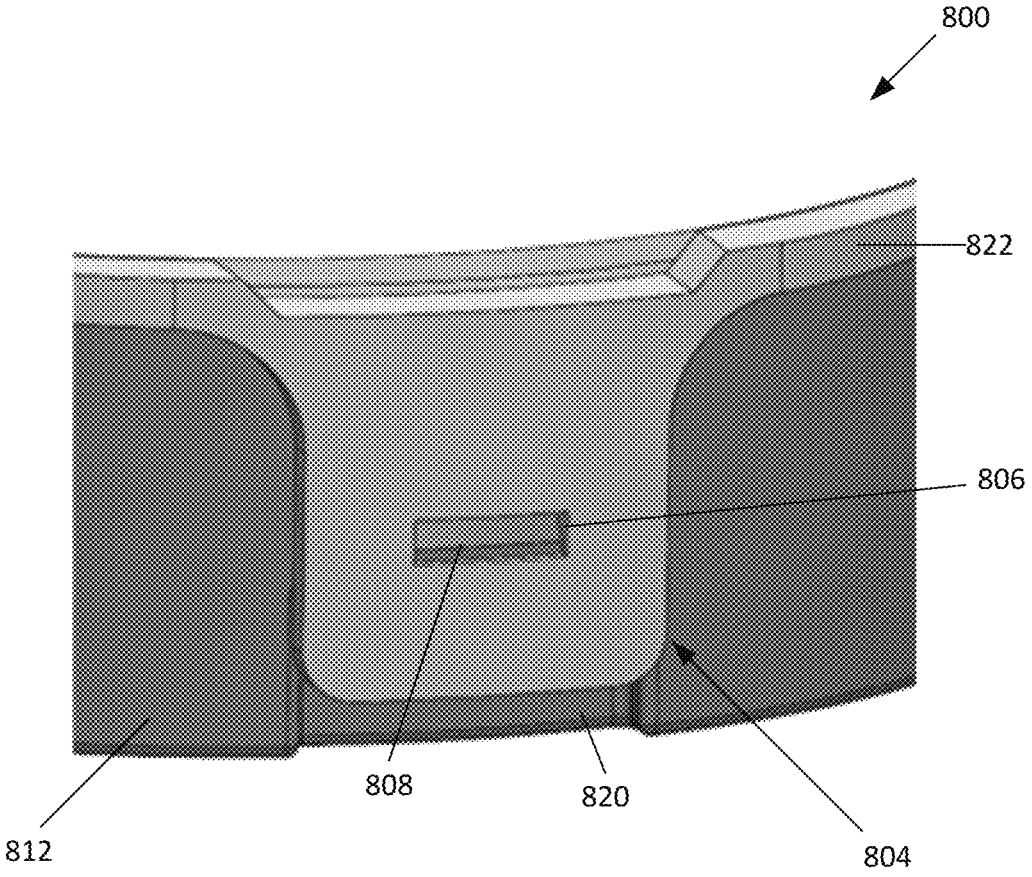
FIG. 8B illustrates a portion of a child-resistant can in accordance with one embodiment.
Figure 8C:
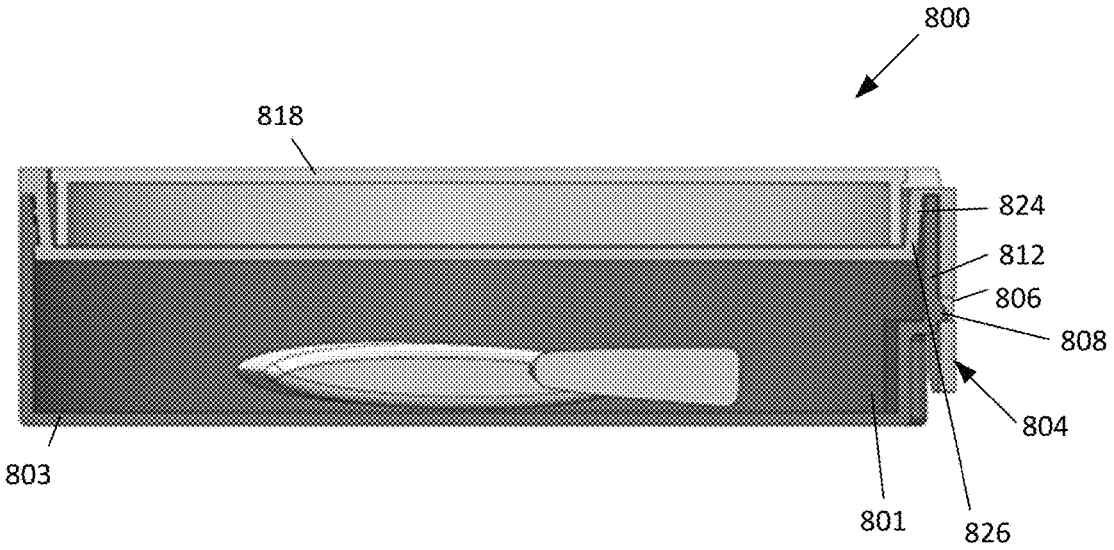
FIG. 8C illustrates a cross-section of a portion of a child-resistant can in accordance with one embodiment.
Figure 8D:
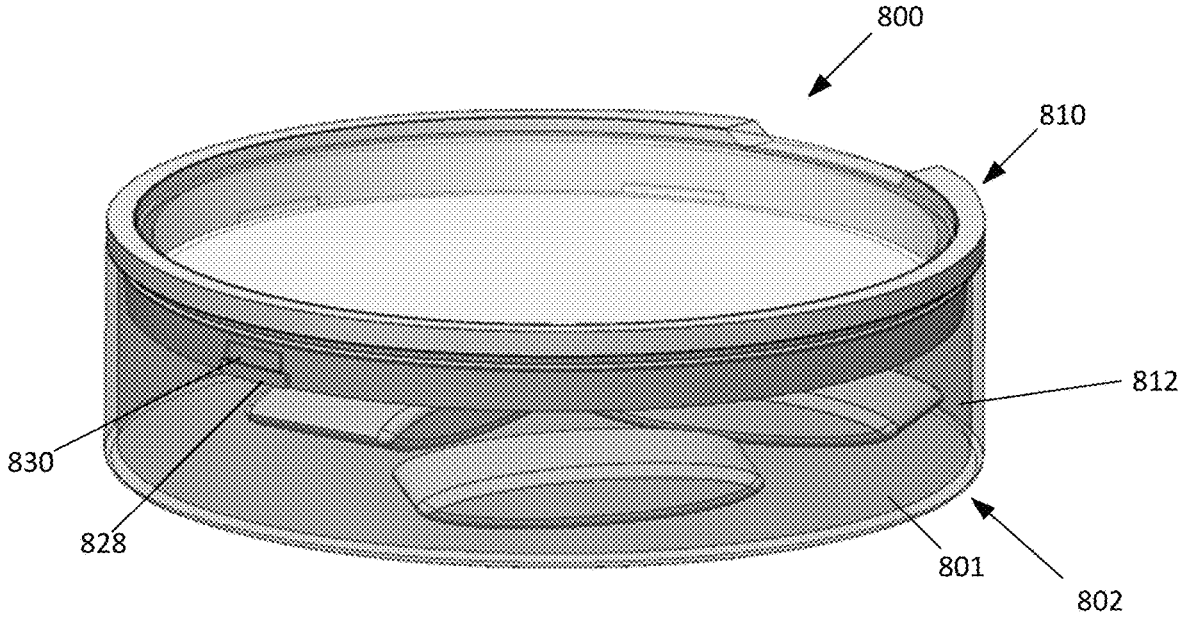
FIG. 8D illustrates a child-resistant can in accordance with one embodiment.

FIG. 8A illustrates the lid 810 coupled to the base 802. To uncouple the lid 810 from the base 802, a user may first pull the snap-fit connectors 804 outward, thereby disengaging the at least one exterior base projection 808 from the hole 806. A user may then rotate the lid 810 such that the at least one lid projection 828 is disengaged from the at least one interior base projection 830. The user may then lift the lid 810 from the base 802, thereby removing the lid 810 from the base 802.

To recouple the lid 810 to the base 802. A user may first push the lid 810 downward on to the base 802 while the snap-fit connectors 804 (and hole 806) is misaligned from the recess 820 (and the projection 808), such that the hole 806 and the at least one exterior projection 808 are horizontally aligned but not vertically aligned. A user may then rotate the lid 810 such that the at least one interior base projection 830 engages the at least one lid projection 828 and the at least one exterior base projection 808 engages the hole 806, thereby recoupling the lid 810 to the base 802. In some examples, when the lid 810 is recoupled to the base 802, feedback may be provided to the user. For example, the feedback may include visual feedback (e.g., the at least one exterior base projection 808 is received within the hole 806), audible feedback (e.g., the at least one exterior base projection 808 snapping into the hole 806 may provide a clicking noise), and/or tactile feedback (e.g., the at least one exterior base projection 808 snapping into the hole 806 may provide a vibration to the child-resistant can 800).

In some examples, the child-resistant can 800 further includes catch lid 818. In some examples, the catch lid 818 can be coupled to the lid 810 and have similar functionality to the other catch lids described herein. For example, the catch lid 818 may include a projection configured to engage to a projection of the lid 810 to secure the catch lid 818 to the lid 810. The catch lid 818 may include a lip 816 exposed by an indent in the top plate 822. A user may pull on the lip 816 to disengage the catch lid 818 from the lid 810. A cavity may be formed between the catch lid 818 and the lid 810 for storing objects (e.g., used products).

In some examples, the lid circumferential wall 826 may include a sealing ring 824. The sealing ring 824 may be operable to seal the cavity defined by the lid 810, the interior surface 801, and the base circumferential wall 812 such that the one or more products contained within the cavity remain fresh, minimize air and bacterial ingress, by maintaining a vapor moisture barrier.

In some examples, the child-resistant can 800 may have a diameter. In some examples, the diameter may be about 50 mm to about 100 mm. The diameter may be about 50 mm to about 60 mm, about 60 mm to about 70 mm, about 70 mm to about 80 mm, about 80 mm to about 90 mm, or about 90 mm to about 100 mm, or any combination therein. In some examples, the child-resistant can 800 may have a height. In some examples, the height may be about 10 mm to about 30 mm. In some examples, the height may be about 10 mm to about 15 mm, about 15 mm to about 20 mm, about 20 mm to about 25 mm, or about 25 mm to about 30 mm, or any combination therein.

FIGS. 9A to 9H illustrate an embodiment of a child-resistant can 900. The child resistant can 900 may include one or more safety mechanisms operable to prevent a child from opening the child-resistant can 900. For example, the child-resistant can 900 may require sufficient strength to open the child-resistant can 900. In this manner, children may be prevented from opening the child-resistant can 900.

The child-resistant can 900 may include a base 902 and a lid 910. The base 902 may include a bottom plate 901. The base 902 may further include a base circumferential wall 904 extending from the bottom plate 901. In some examples, the base circumferential wall 904 and the bottom plate may define an interior surface 905 and an opposing exterior surface. In some examples, the base circumferential wall 904 may include at least one groove 916(*a*), 916(*b*), 916(*c*), 916(*d*), 916(*e*). In some examples, the at least one groove 916(*a*), 916(*b*), 916(*c*), 916(*d*), 916(*e*) may have a first end 907(*a*) and a second end 907(*b*). In some examples, the at least one groove 916(*a*), 916(*b*), 916(*c*), 916(*d*), 916(*e*) may be formed in an exterior surface of the base circumferential wall 904. In some examples, the at least one groove 916(*a*), 916(*b*), 916(*c*), 916(*d*), 916(*e*) may be a cut out in the exterior surface of the base circumferential wall 904.

In some examples, the at least one groove 916(*a*), 916(*b*), 916(*c*), 916(*d*), 916(*e*) may include at least one sloped surface 932(*a*), 932(*b*), 932(*c*), 932(*d*), 932(*e*). In some examples, the at least one sloped surface 932(*a*), 932(*b*), 932(*c*), 932(*d*), 932(*e*) may located at the second end 907(*b*). For example, the depth of the at least one groove may decrease near the second end 907(*a*), thereby forming the sloped surface 932(*a*), 932(*b*), 932(*c*), 932(*d*), 932(*e*).

The lid 910 may include a top plate 908. The lid 910 may further include a lid circumferential wall 906 extending from the top plate 908. In some examples, the lid circumferential wall 906 may be configured to abut against an exterior surface of the base circumferential wall 904. In some examples, the lid circumferential wall 906 may include at least one projection 918(*a*), 918(*b*), 918(*c*), 918(*d*), 918(*e*) extending inward from the lid circumferential wall 906. The at least one projection 918(*a*), 918(*b*), 918(*c*), 918(*d*), 918(*e*) may be operable to be received within the at least one groove 916(*a*), 916(*b*), 916(*c*), 916(*d*), 916(*e*). In some examples, the at least one projection 918(*a*), 918(*b*), 918(*c*), 918(*d*), 918(*e*) may have at least one sloped surface 934(*a*), 934(*b*), 934(*c*), 934(*d*), 934(*e*) (e.g., horizontal tapered surface). In some examples, at least one sloped surface 934(*a*), 934(*b*), 934(*c*), 934(*d*), 934(*e*) may be at an end of the at least one projection 918(*a*), 918(*b*), 918(*c*), 918(*d*), 918(*e*) configured to contact the second end 907(*b*). In some examples, at least one sloped surface 934(*a*), 934(*b*), 934(*c*), 934(*d*), 934(*e*) means that the at least one projection 918(*a*), 918(*b*), 918(*c*), 918(*d*), 918(*e*) decreases in thickness near an end of the 918(*a*), 918(*b*), 918(*c*), 918(*d*), 918(*e*).

In some examples, the at least one sloped surface 934(*a*), 934(*b*), 934(*c*), 934(*d*), 934(*e*) of the at least one projection 918(*a*), 918(*b*), 918(*c*), 918(*d*), 918(*e*) and the at least one sloped surface 932(*a*), 932(*b*), 932(*c*), 932(*d*), 932(*e*) of the at least one groove 916(*a*), 916(*b*), 916(*c*), 916(*d*), 916(*e*) may be configured to abut against one another (e.g., interface with one another) to aid in removing the lid 910 from the base 902. In some examples, only one end of the at least one groove 916(*a*), 916(*b*), 916(*c*), 916(*d*), 916(*e*) and one end of the at least one projection 918(*a*), 918(*b*), 918(*c*), 918(*d*), 918(*e*) may have a sloped surface. In other examples, both ends of the at least one groove 916(*a*), 916(*b*), 916(*c*), 916(*d*), 916(*e*) and both ends of the at least one projection 918(*a*), 918(*b*), 918(*c*), 918(*d*), 918(*e*) may have the sloped surface.

In some examples, the at least one sloped surface 934(*a*), 934(*b*), 934(*c*), 934(*d*), 934(*e*) of the at least one projection 918(*a*), 918(*b*), 918(*c*), 918(*d*), 918(*e*) and the at least one sloped surface 932(*a*), 932(*b*), 932(*c*), 932(*d*), 932(*e*) of the at least one groove 916(*a*), 916(*b*), 916(*c*), 916(*d*), 916(*e*) may be sloped at an angle of about 10 degrees to about 20 degrees, about 20 degrees to about 30 degrees, about 30 degrees to about 40 degrees, about 40 degrees to about 50 degrees, about 50 degrees to about 60 degrees, about 60 degrees to about 70 degrees, or about 70 degrees to about 80 degrees. In some examples, the at least one sloped surface 934(*a*), 934(*b*), 934(*c*), 934(*d*), 934(*e*) of the at least one projection 918(*a*), 918(*b*), 918(*c*), 918(*d*), 918(*e*) and the at least one sloped surface 932(*a*), 932(*b*), 932(*c*), 932(*d*), 932(*e*) of the at least one groove 916(*a*), 916(*b*), 916(*c*), 916(*d*), 916(*e*) may be sloped at an angle of about 30 degrees to about 60 degrees. In some examples, the at least one sloped surface 934(*a*), 934(*b*), 934(*c*), 934(*d*), 934(*e*) of the at least one projection 918(*a*), 918(*b*), 918(*c*), 918(*d*), 918(*e*) and the at least one sloped surface 932(*a*), 932(*b*), 932(*c*), 932(*d*), 932(*e*) of the at least one groove 916(*a*), 916(*b*), 916(*c*), 916(*d*), 916(*e*) may be sloped at an angle of about 45 degrees.

Figure 9A:
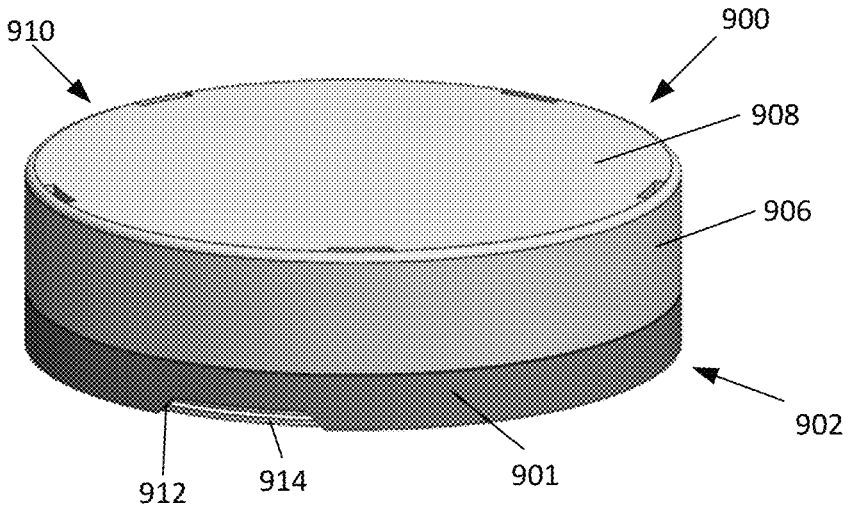
FIG. 9A illustrates a child-resistant can in accordance with one embodiment.
Figure 9B:
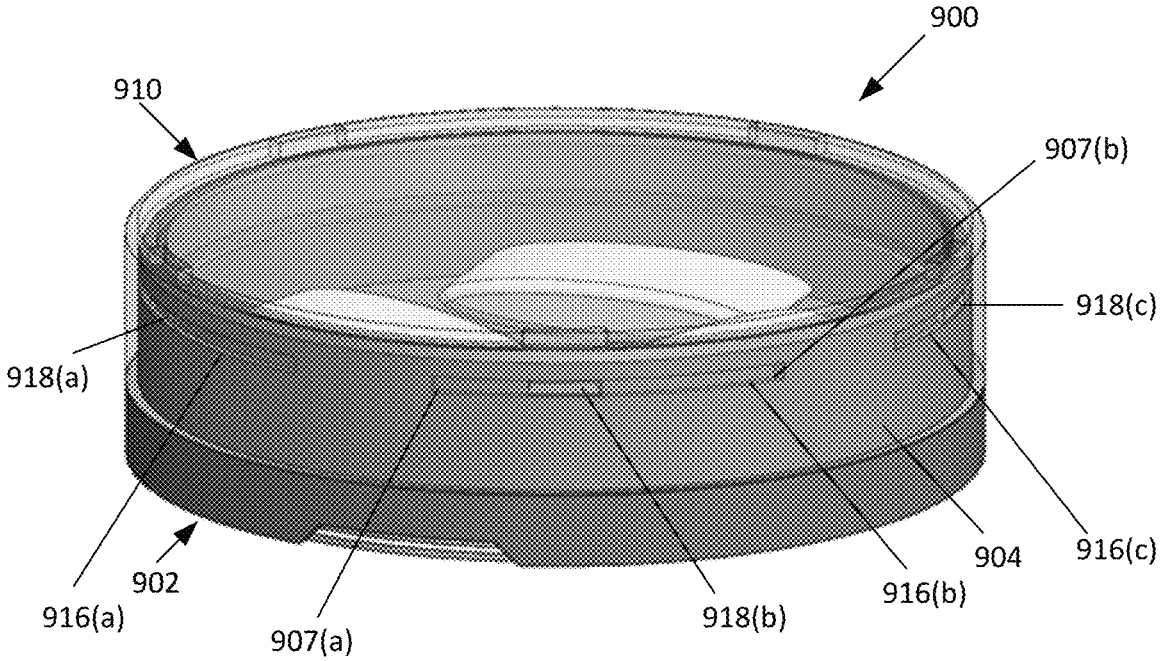
FIG. 9B illustrates a child-resistant can in accordance with one embodiment.
Figure 9C:
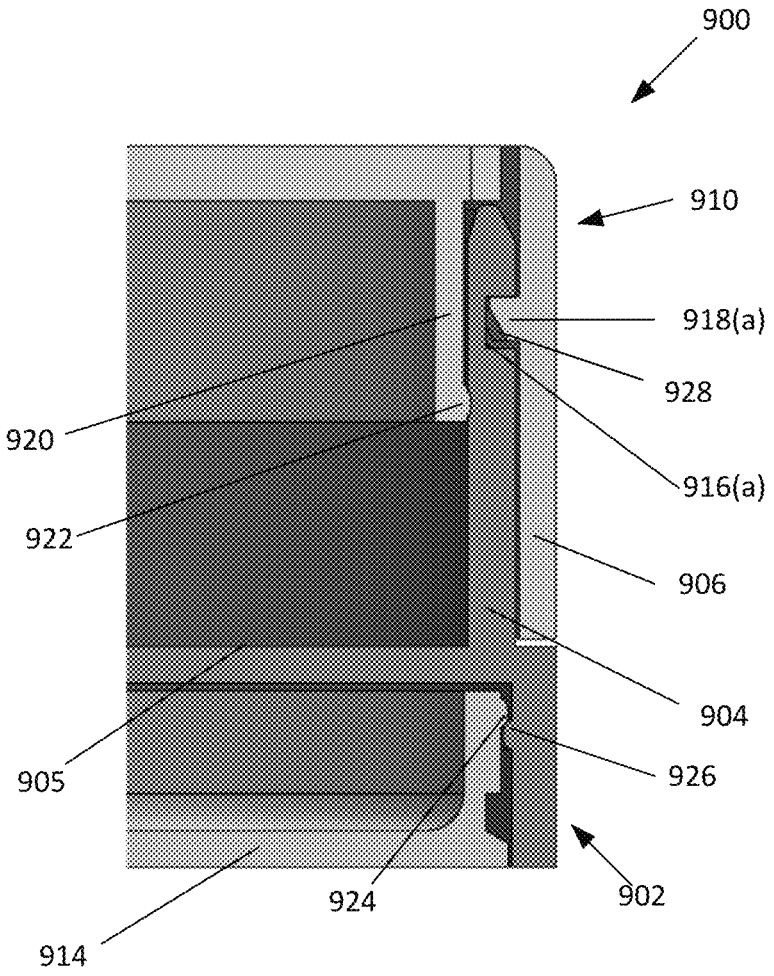
FIG. 9C illustrates a cross-section of a portion of a child-resistant can in accordance with one embodiment.
Figure 9D:
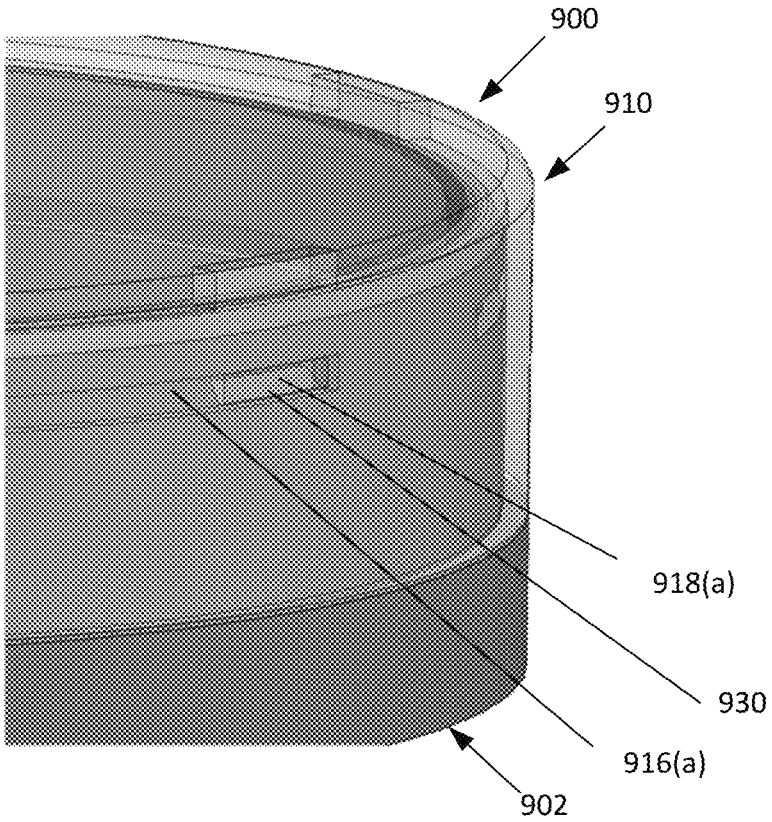
FIG. 9D illustrates a portion of a child-resistant can in accordance with one embodiment.
Figure 9E:
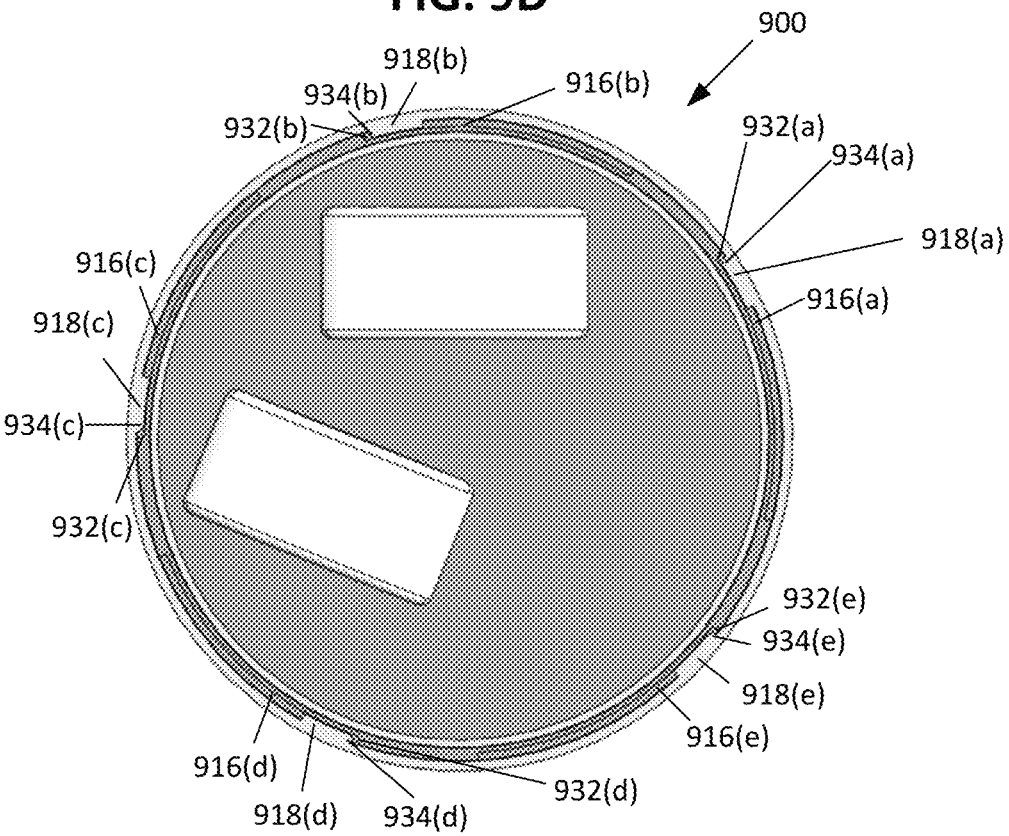
FIG. 9E illustrates a child-resistant can in accordance with one embodiment.
Figure 9F:
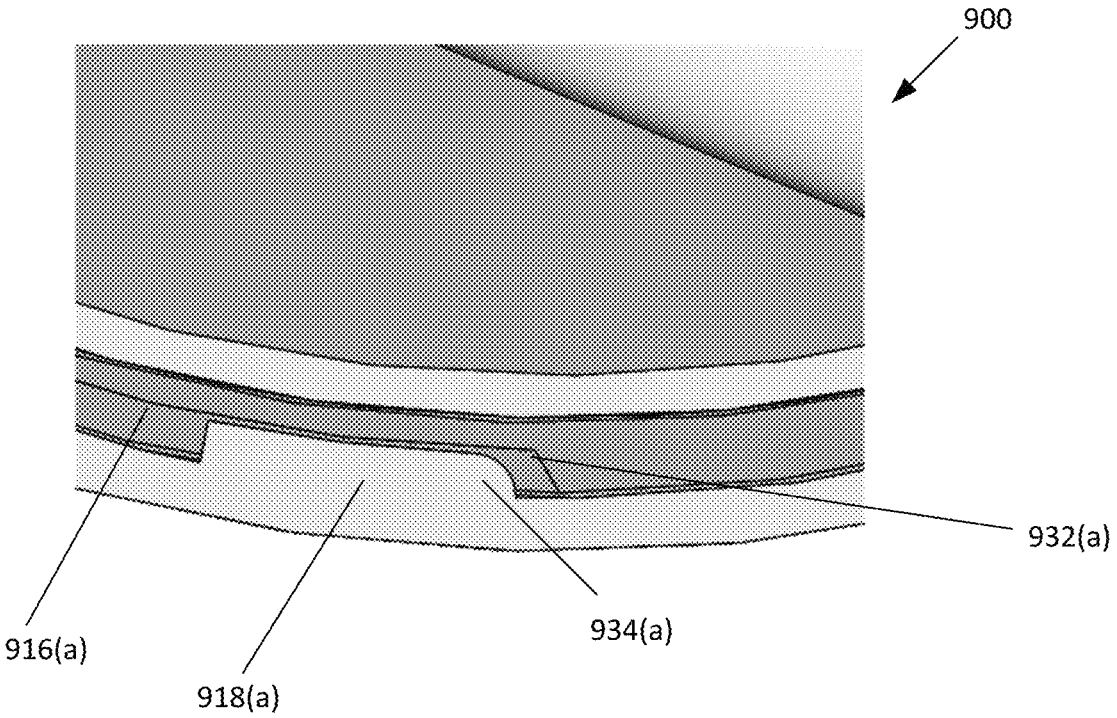
FIG. 9F illustrates a portion of a child-resistant can in accordance with one embodiment.
Figure 9G:
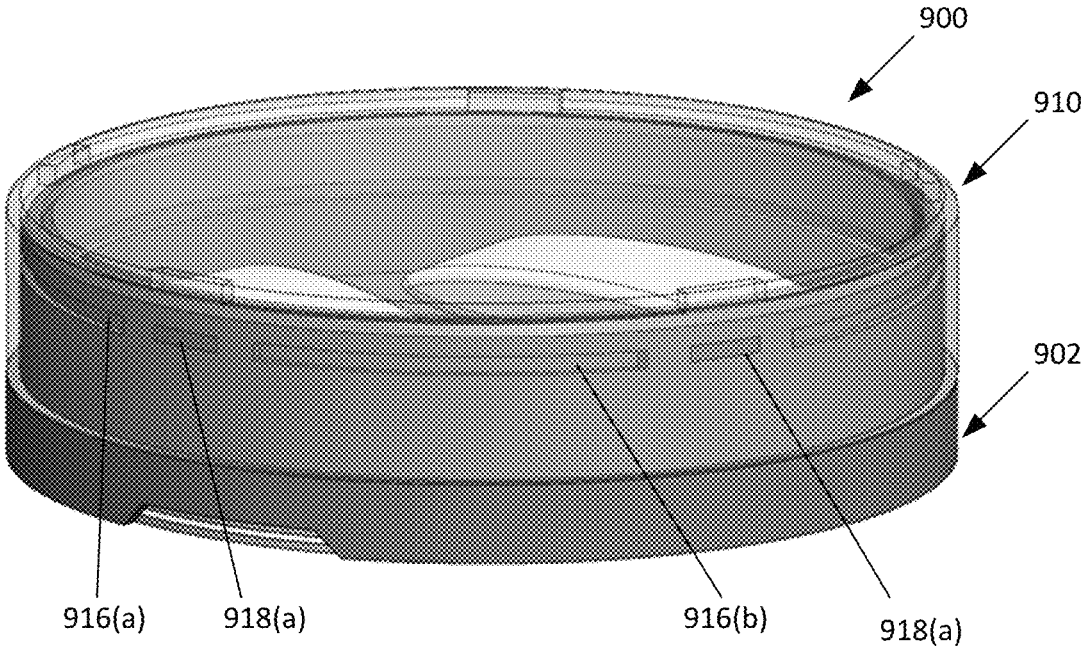
FIG. 9G illustrates a child-resistant can in accordance with one embodiment.
Figure 9H:
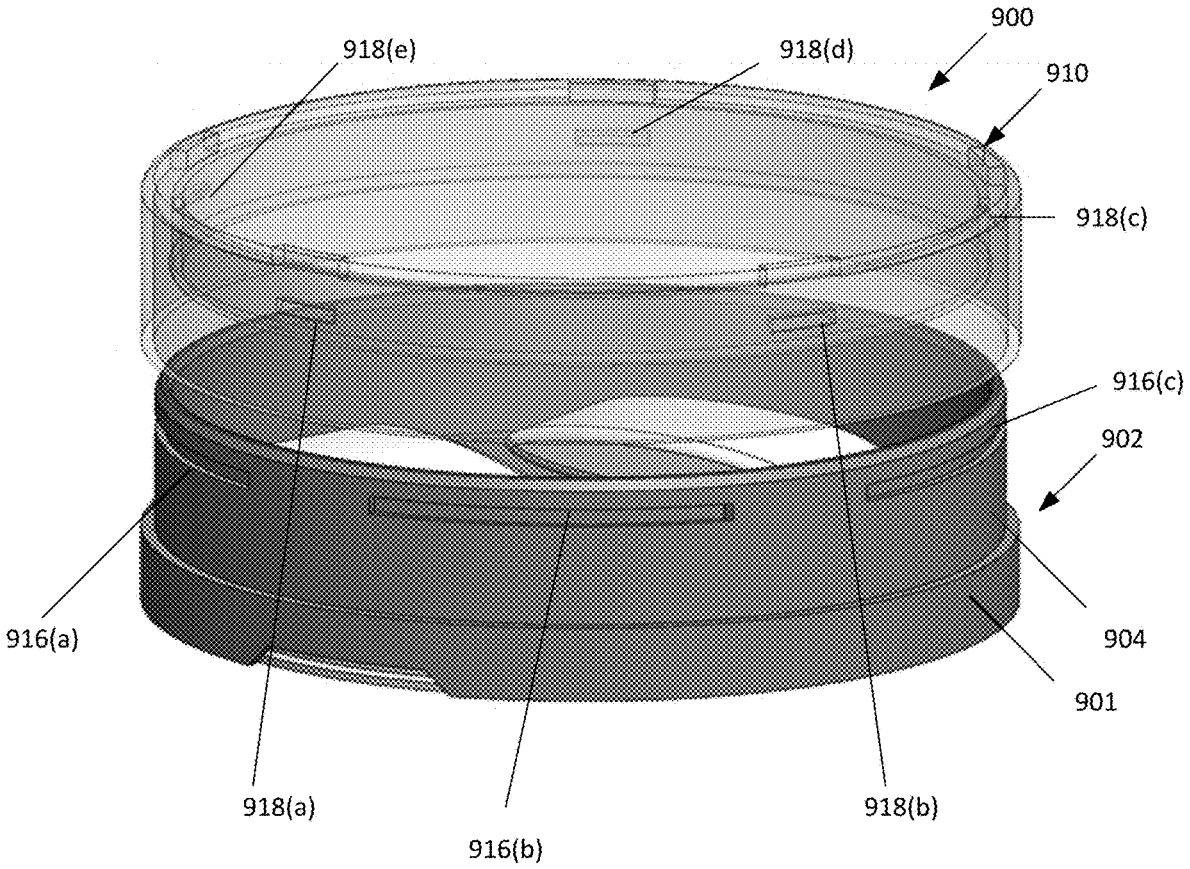
FIG. 9H illustrates a child-resistant can in accordance with one embodiment.

In some examples, the at least one projection 918(*a*), 918(*b*), 918(*c*), 918(*d*), 918(*e*) may further include a vertical sloped surface 930, as illustrated, for example, in FIG. 9D. The vertical sloped surface 930 may cause the projection to decrease in thickness from an upper end (e.g., nearest the top plate 908) to a lower end (e.g., nearest the edge of the lid circumferential wall 906). In some examples, the vertical sloped surface 930 may be operable to aid in reengaging the at least one projection 918(*a*), 918(*b*), 918(*c*), 918(*d*), 918(*e*) to the at least one groove 916(*a*), 916(*b*), 916(*c*), 916(*d*), 916(*e*). In some examples, the vertical sloped surface 930 may have an angle of decrease in thickness of about 10 degrees to about 20 degrees, about 20 degrees to about 30 degrees, about 30 degrees to about 40 degrees, about 40 degrees to about 50 degrees, about 50 degrees to about 60 degrees, about 60 degrees to about 70 degrees, or about 70 degrees to about 80 degrees. In some examples, the vertical sloped surface 930 may have an angle of decrease in thickness of about 30 degrees to about 60 degrees. In some examples, the vertical sloped surface 930 may have an angle of decrease in thickness of about 45 degrees.

The at least one groove 916(*a*), 916(*b*), 916(*c*), 916(*d*), 916(*e*) may be configured to secure the at least one projection 918(*a*), 918(*b*), 918(*c*), 918(*d*), 918(*e*) such that a user cannot pull the lid 910 straight upwards to remove the lid 910 from the base 902.

FIG. 9B illustrates the lid 910 attached to the base 902. To remove the lid 910 from the base 902, a user may provide a sufficient rotational force to the lid 910 such that the at least one projection 918(*a*), 918(*b*), 918(*c*), 918(*d*), 918(*e*) slides out of the at least one groove 916(*a*), 916(*b*), 916(*c*), 916(*d*), 916(*e*), as illustrated, for example, in FIG. 9G, thereby disengaging the at least one projection 918(*a*), 918(*b*), 918(*c*), 918(*d*), 918(*e*) from the at least one groove 916(*a*), 916(*b*), 916(*c*), 916(*d*), 916(*e*). The user may then be able to remove the lid 910 from the base 902 by pulling the lid upwards, as illustrated, for example, in FIG. 9H.

In some examples, to reattach the lid 910 to the base 902, a user may simply push the lid 910 downwards on to the base 902, thereby allowing the at least one projection 918(*a*), 918(*b*), 918(*c*), 918(*d*), 918(*e*) to be received in and engaged to the at least one groove 916(*a*), 916(*b*), 916(*c*), 916(*d*), 916(*e*). In some examples, if the at least one projection 918(*a*), 918(*b*), 918(*c*), 918(*d*), 918(*e*) is not vertically aligned with the at least one groove 916(*a*), 916(*b*), 916(*c*), 916(*d*), 916(*e*), the user may rotate the lid 910 until the at least one projection 918(*a*), 918(*b*), 918(*c*), 918(*d*), 918(*e*) is received in and engaged to the at least one groove 916(*a*), 916(*b*), 916(*c*), 916(*d*), 916(*e*). In some examples, an indication may be provided to a user that the lid 910 is reattached to the base 902. For example, an audible indication (e.g., clicking noise when the projections are received in the grooves) and/or tactile indication (e.g., a vibration when the projections are received in the grooves) may be provided.

In some examples, the at least one projection 918(*a*), 918(*b*), 918(*c*), 918(*d*), 918(*e*) may include 1, 2, 3, 4, 5, 6, or more projections. In some examples, the at least one groove 916(*a*), 916(*b*), 916(*c*), 916(*d*), 916(*e*) may include 1, 2, 3, 4, 5, 6, or more grooves.

As illustrated in FIG. 9C, the lid circumferential wall 906 may include an exterior wall and an interior wall 920 configured to surround the base circumferential wall 904. In some examples, the interior wall 920 may be include a sealing ring 922. In some examples, sealing ring 922 may be operable to seal the cavity defined by the lid 910, the interior surface 905, and the base circumferential wall 904 such that the one or more products contained within the cavity remain fresh, minimize air and bacterial ingress, by maintaining a vapor moisture barrier.

In some examples, the child-resistant can 900 may include a catch lid 914. The catch lid 914 may have similar functionality to the other catch lids described herein. For example, the catch lid 914 may include a projection 924 configured to engage to an interior projection 926 of the base 902, thereby securing the catch lid 914 to the base 902. The catch lid 914 and the base 902 may define a cavity for receiving one or more objects (e.g., used products). In some examples, base 902 may include an opening 912 configured to expose the catch lid 914 such that a user may pull on the catch lid 914 to open the cavity defined by the catch lid.

In some examples, the child-resistant can 900 may have a diameter. In some examples, the diameter may be about 50 mm to about 100 mm. The diameter may be about 50 mm to about 60 mm, about 60 mm to about 70 mm, about 70 mm to about 80 mm, about 80 mm to about 90 mm, or about 90 mm to about 100 mm, or any combination therein. In some examples, the child-resistant can 900 may have a height. In some examples, the height may be about 10 mm to about 30 mm. In some examples, the height may be about 10 mm to about 15 mm, about 15 mm to about 20 mm, about 20 mm to about 25 mm, or about 25 mm to about 30 mm, or any combination therein.

In some embodiments, the disclosed cans may be metal cans. For example, the disclosed cans may include or may be made entirely or largely out of a metal. For example, the can may be at least 80%, at least 90%, at least 95%, or at least 98% by weight metal. The metal may include one or more of aluminum, tinplate (steel with a thin layer of tin), chromed steel (steel with a thin layer of chromium), stainless steel, zinc, copper, or the like. According to some alternative embodiments, the disclosed cans may be entirely or largely out of a plastic. For example, the can may be at least 80%, at least 90%, at least 9%, or at least 98% by weight plastic. The plastic may include one or of polypropylene (PP), polyethylene terephthalate (PET), high-density polyethylene (HDPE), low-density polyethylene (LDPE), polyvinyl chloride (PVC), polystyrene (PS), polylactic acid (PLA), Ethylene Vinyl Alcohol (EVOH), polycarbonate (PC), PCTG, or the like.

In some embodiments, the cans may be designed to be disposable, consistent with conventional cans for oral nicotine dosage forms such as pouches. In such embodiments, as well as in other instances, it may be advantageous for the cans to contain or be entirely made from a cost-effective metal such as aluminum. In some embodiments, it may also be desirable for the cans to contain or be made entirely out of biodegradable or compostable materials. A biodegradable or compostable material may be a material which decomposes in 6 months or less, 1 year or less, 2 years or less, 5 years or less, 10 years or less, 20 years or less, 50 years or less, or 100 years or less when exposed to natural conditions including one or more of moisture, soil, microbes, heat, and the like, or to industrial composting conditions. Such materials may include a biodegradable or compostable plastic. In an embodiment, the plastic may include eco-friendly, biodegradable, or otherwise compostable plastic. In a non-limiting example, such plastic may include a plant-based plastic such as polylactic acid (PLA), polyhydroalkanoates (PHAs), polyhydroxy butyrate (PHB), polyhydroxyvalerate (PHV), polyhydroxy hexanoate (PHH), and the like. In another non-limiting example, such plastic may also include petroleum-based plastics such as polyglycolic acid (PGA), polybutylene succinate (PBS), polycaprolactone (PCL), polybutylene adipate terephthalate (PBAT), Oxo-degradable polypropylene (oxo-PP), and the like.

In some cases, and particularly in embodiments where cans employ biodegradable and/or compostable materials, there may be concern about potential leachables and/or extractables and/or early decomposition of the cans. To mitigate this concern, in some embodiments, the disclosed cans may include an interior coating applied to a portion of or entirely covering the surface of the storage cavity. Such a coating may comprise one or more of epoxy coatings including one or more of AP4, AP6, Epoxy-1, Bisphenal A diglycidyl ether (DBEBA), or BPA-free epoxy coatings; polyethylene; polypropylene; polyvinyl; wax; or aluminum. The composition and thickness of the interior coating may be chosen to prevent leaching, migration, or other loss of known extractables/leachables from the interior of the storage cavity and/or from the dosage forms stored therein. The interior coating may also have additional benefits such as providing a barrier to oxygen, light, moisture, and the like. According to some exemplary embodiments, the interior coating may have a thickness of less than 0.015 mm, between 0.015 mm to 0.03 mm, between 0.03 mm and 0.04 mm, between 0.04 mm and 0.05 mm, and thicker than 0.05 mm. For instance, epoxy coatings can be effective in the range of 0.02 mm to 0.04 mm, whereas polyester coatings may be thinner at 0.015 mm to 0.03 mm. It is important to select an appropriate thickness for the coating, e.g., as disclosed herein, because too small a thickness may be insufficient to protect from leachables or insufficient to satisfy regulatory standards on safety. While thicker coatings protect more thoroughly from potential leachables, they come at an increased cost and may impact the biodegradable/compostable timeline of the material.

According to some embodiments, the disclosed cans may include pieces (e.g., seals, flexible seams) requiring more elasticity than a typical metal or plastic. To the extent feasible, such pieces may also be made of a biodegradable or compostable material, such as one or more of the aforementioned materials, so long as such material can provide the required elasticity. In alternative embodiments, such pieces may include or be formed from silicone, either alone or in combination with one or more of the aforementioned compostable or biodegradable materials.

As described herein, the devices, systems, and methods can provide several significant advantages and benefits over other devices, systems, and methods for child-proofing (or making child-resistant) cans, currently available in the art. However, the recited advantages are not meant to be limiting in any way, as one skilled in the art will appreciate that other advantages may also be realized upon practicing the present disclosure. It will be appreciated, moreover, that other applications for the disclosed cans are also possible and considered to fall within the scope of the present disclosure.

Furthermore, those skilled in the relevant art will recognize that changes can be made to the described embodiments while still obtaining the beneficial results. It will also be apparent that some of the advantages and benefits of the described embodiments can be obtained by selecting some of the features of the embodiments without utilizing other features, and that features from one embodiment may be combined with features from other embodiments in any appropriate combination. For example, any individual or collective features of method embodiments may be applied to apparatus, product or system embodiments, and vice versa. Accordingly, those who work in the art will recognize that many modifications and adaptations to the embodiments described are possible and may even be desirable in certain circumstances, and are a part of the disclosure. Thus, the present disclosure is provided as an illustration of the principles of the embodiments and not in limitation thereof, since the scope of the invention is to be defined by the claims.

What is claimed:

1. A child-resistant can comprising:

a base comprising:

a bottom plate;

a base circumferential wall surrounding and extending from the bottom plate, the bottom plate and the base circumferential wall defining an interior surface and an opposing exterior surface, the base circumferential wall comprising a base projection extending inward from the interior surface, and a snap-fit connector comprising a body and a snap projection extending from an upper portion of the body; and a lid configured to enclose the interior surface, the lid comprising:

a top plate comprising an indent configured to receive the snap projection, the indent comprising a recessed portion configured to engage the snap projection; and a lid circumferential wall extending from the top plate and configured to abut against the interior surface of the base circumferential wall, the lid circumferential wall comprising a lid projection vertically aligned with the recessed portion, wherein the base projection is configured to abut against an upper surface of the lid projection when the lid is coupled to the base, and wherein the snap-fit connector is configured to be pulled outward from the base circumferential wall, thereby disengaging the snap projection from the recessed portion.

2. The child-resistant can of claim 1, wherein the snap-fit connector is integrally formed from a portion of the base circumferential wall.

3. The child-resistant can of claim 2, wherein the body of the snap-fit connector extends from the base circumferential wall at one end and is disconnected at the remaining ends.

4. The child-resistant can of claim 1, wherein the can is configured to provide at least one of audible, visual, or tactile feedback to a user when the snap projection engages with the recessed portion.

5. The child-resistant can of claim 1, wherein the snap-fit connector comprises a plurality of snap-fit connectors.

6. The child-resistant can of claim 1, wherein a diameter of the can is within a range of about 50 mm to about 100 mm.

7. The child-resistant can of claim 6, wherein the diameter of the can is within a range of about 60 mm to about 90 mm.

8. The child-resistant can of claim 1, wherein a height of the can is within a range of about 10 mm to about 30 mm.

9. The child-resistant can of claim 8, wherein the height of the can is within a range of about 15 mm to about 25 mm.

10. The child-resistant can of claim 1, wherein a width of the snap-fit connector is within a range of about 10 mm to about 20 mm.

11. The child-resistant can of claim 10, wherein the width of the snap-fit connector is within a range of about 12 mm to about 17 mm.

12. The child-resistant can of claim 1, wherein the can comprises at least one of aluminum, a plant-based plastic, or a petroleum-based plastic.

13. The child-resistant can of claim 12, wherein the can is formed of a biodegradable material.

14. The child-resistant can of claim 12, wherein the plant-based plastic is one or more selected from the group consisting of polylactic acid (PLA), polyhydroalkanoates (PHAs), polyhydroxy butyrate (PHB), polyhydroxyvalerate (PHV), and polyhydroxy hexanoate (PHH); and the petroleum-based plastic is one or more selected from the group consisting of polyglycolic acid (PGA), polybutylene succinate (PBS), polycaprolactone (PCL), polybutylene adipate terephthalate (PBAT), and oxo-degradable polypropylene (oxo-PP).

15. The child-resistant can of claim 1, wherein the snap projection includes an angled surface configured to aid in removal of the snap projection from the recessed portion.

16. The child-resistant can of claim 15, wherein the base circumferential wall comprises an inner base circumferential wall and an outer shell.

17. The child-resistant can of claim 16, wherein the snap-fit connector is integrally formed in the outer shell and the base projection is disposed on the inner base circumferential wall.

18. The child-resistant can of claim 16, wherein the inner base circumferential wall includes a groove operable to secure to a shell projection of the outer shell.

19. A method for opening the child-resistant can of claim 1, comprising:

pulling the body of the snap-fit connector radially outward from the can to disengage the snap projection from the recessed portion;

rotating the lid to disengage the lid projection from the base projection; and lifting the lid to remove the lid from the base.

20. A method for closing the child-resistant can of claim 1, comprising:

pulling the body of the snap-fit connector radially outward from the can;

placing the lid on the base such that the snap projection contacts the indent, but is not within the recessed portion; and rotating the lid to engage the lid projection with the base projection and to engage the snap projection with the recess.

* * * * *